US006688813B2

(12) United States Patent
Kennedy et al.

(10) Patent No.: US 6,688,813 B2
(45) Date of Patent: Feb. 10, 2004

(54) MINE STOPPING AND METHOD OF INSTALLING SAME

(75) Inventors: William R. Kennedy, Taylorville, IL (US); John M. Kennedy, Taylorville, IL (US)

(73) Assignee: Jack Kennedy Metal Products, Inc., Taylorville, IL (US)

( * ) Notice: Subject to any disclaimer, the term of this patent is extended or adjusted under 35 U.S.C. 154(b) by 0 days.

(21) Appl. No.: 09/903,429

(22) Filed: Jul. 11, 2001

(65) Prior Publication Data

US 2003/0017005 A1 Jan. 23, 2003

(51) Int. Cl.[7] ..... E21F 1/14; E21D 11/00
(52) U.S. Cl. ..... 405/132; 454/169
(58) Field of Search ..... 454/169; 405/132, 405/151, 152; 49/501, 465

(56) References Cited

U.S. PATENT DOCUMENTS

| | | | | | |
|---|---|---|---|---|---|
| 283,286 | A | * | 8/1883 | Sawyer | 49/326 |
| 1,594,921 | A | | 8/1926 | Barnett | |
| 2,729,064 | A | | 1/1956 | Kennedy, et al. | |
| 3,186,177 | A | | 6/1965 | Kannenberg | |
| 3,972,272 | A | | 8/1976 | Bagby | |
| 4,345,857 | A | | 8/1982 | Krings | |
| 4,483,642 | A | | 11/1984 | Kennedy et al. | |
| 4,484,837 | A | | 11/1984 | Kennedy et al. | |
| 4,547,094 | A | | 10/1985 | Kennedy et al. | |
| 4,685,837 | A | | 8/1987 | Cicanese | |
| 4,695,035 | A | | 9/1987 | Kennedy et al. | |
| RE32,675 | E | | 5/1988 | Kennedy et al. | |
| RE32,871 | E | | 2/1989 | Kennedy et al. | |
| 4,820,081 | A | | 4/1989 | Kennedy et al. | |
| 4,911,577 | A | | 3/1990 | Kennedy et al. | |
| 5,167,474 | A | | 12/1992 | Kennedy et al. | |
| RE34,220 | E | | 4/1993 | Kennedy et al. | |
| 5,222,838 | A | | 6/1993 | Kennedy et al. | |
| 5,412,916 | A | | 5/1995 | Kennedy et al. | |
| 5,466,187 | A | | 11/1995 | Kennedy et al. | |
| 5,644,879 | A | * | 7/1997 | Shreiner et al. | 52/393 |
| RE36,853 | E | | 9/2000 | Kennedy et al. | |
| 6,164,871 | A | | 12/2000 | Kennedy et al. | |
| 6,220,785 | B1 | | 4/2001 | Kennedy et al. | |
| 6,264,549 | B1 | | 7/2001 | Kennedy et al. | |
| 6,402,611 | B1 | * | 6/2002 | Rohrbaugh | 405/152 |
| 6,419,324 | B1 | * | 7/2002 | Kennedy et al. | 299/12 |

OTHER PUBLICATIONS

U.S. patent application Ser. No. 09/044,455, Kennedy et al.
U.S. patent application Ser. No. 09/464,808, Kennedy et al.
Kwic–Wall Mine Stoppings Brochure, Rohmac, Inc., Publication Date Unknown, Received by Applicants Jun., 2001.

* cited by examiner

*Primary Examiner*—Heather Shackelford
*Assistant Examiner*—Lisa M. Saldano
(74) *Attorney, Agent, or Firm*—Senniger, Powers, Leavitt & Roedel

(57) ABSTRACT

A portable wall section for incorporation in a mine stopping or for use as a mine permanent stopping or seal form, comprising vertically extensible panels secured in side-by-side relation, a stopping installed in a mine, a stopping system utilizing one or more of said sections, and methods of installing the stopping and form.

38 Claims, 21 Drawing Sheets

MINE STOPPING AND METHOD OF INSTALLING SAME

BACKGROUND OF THE INVENTION

This invention relates to mine stoppings, more particularly to a wall section per se for installation in a mine passageway, usually one with another to constitute a stopping or a permanent stopping form, the resultant stopping, and the methods of installation of the stopping and permanent stopping form in the passageway.

Reference may be had to the following prior U.S. patents, all of which are incorporated herein by reference, for disclosure of predecessors of the stopping and permanent stopping form of this invention:

| U.S. Pat. No. | Inventor(s) | Date |
|---|---|---|
| 2,729,064 | Kennedy et al. | Jan. 3, 1956 |
| Re.32,871 | Kennedy et al. | Feb. 21, 1989 |
| 4,483,642 | Kennedy et al. | Nov. 20, 1984 |
| 5,167,474 | Kennedy et al. | Dec. 1, 1992 |

Stoppings and permanent stopping forms of the type shown in said prior U.S. patents have been widely used over the years and have generally been readily installed and quite satisfactory. But with increasing labor costs, especially for labor down in a mine, the cost of installation has increased. This is due, for example, to the considerable labor time down in the mine, with attendant considerable cost involved, in making holes (e.g. the holes 51 shown in U.S. Pat. No. 4,483,642) in the ribs of the passageway where the stopping is to be installed for the horizontally extending bars (e.g. bars 3 shown in U.S. Pat. No. 4,483,642), setting up the extensible panels (e.g. panels 7 shown in U.S. Pat. No. 4,483,642) one at a time, and applying wire ties (such as ties 9 shown in U.S. Pat. No. 4,483,642).

BRIEF SUMMARY OF THE INVENTION

Among the several objects of the invention may be noted the provision of a stopping and permanent stopping form construction which makes possible a reduction in labor time required for installation of the stopping; the provision of a stopping and permanent stopping form construction eliminating, for example, the necessity for making holes in the ribs of the passageway where the stopping is to be installed, the setting of a bar in such holes, and the setting up of the extensible panels one at a time; the provision of a stopping system embodying said construction; and the provision of a method of installation utilizing said construction.

The invention involves a portable wall section comprising a plurality of elongate upright panels secured in adjacent side-by-side relation. Each panel comprises a lower panel member having a lower end and an upper panel member extensible in an upward direction relative to the lower panel member for adjusting the overall height of the panel to accommodate mine passages of different heights. The panels form a portable assembly which can be transported to an installation site in the mine passageway. The stopping system of the invention generally comprises one or more of said wall sections and, where the system includes more than one wall section, means connecting them to form a wall across the mine passageway. A permanent mine stopping form of the invention generally comprises first and second form walls in parallel relation to one another wherein at least one of the form walls comprises a portable wall section. The methods of the invention generally comprise installing a stopping or permanent mine stopping form by positioning one or more of the wall sections generally end-to-end to extend across the mine passage, extending the upper panel members relative to the lower panel members to bring the upper panel members into pressure engagement with the roof of the mine passage, securing the upper panel members relative to the lower panel members in extended position, and closing any gaps between the stopping sections and any gaps between the stopping sections and the side ribs of the mine passage.

Other objects and features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION

Figure 1:
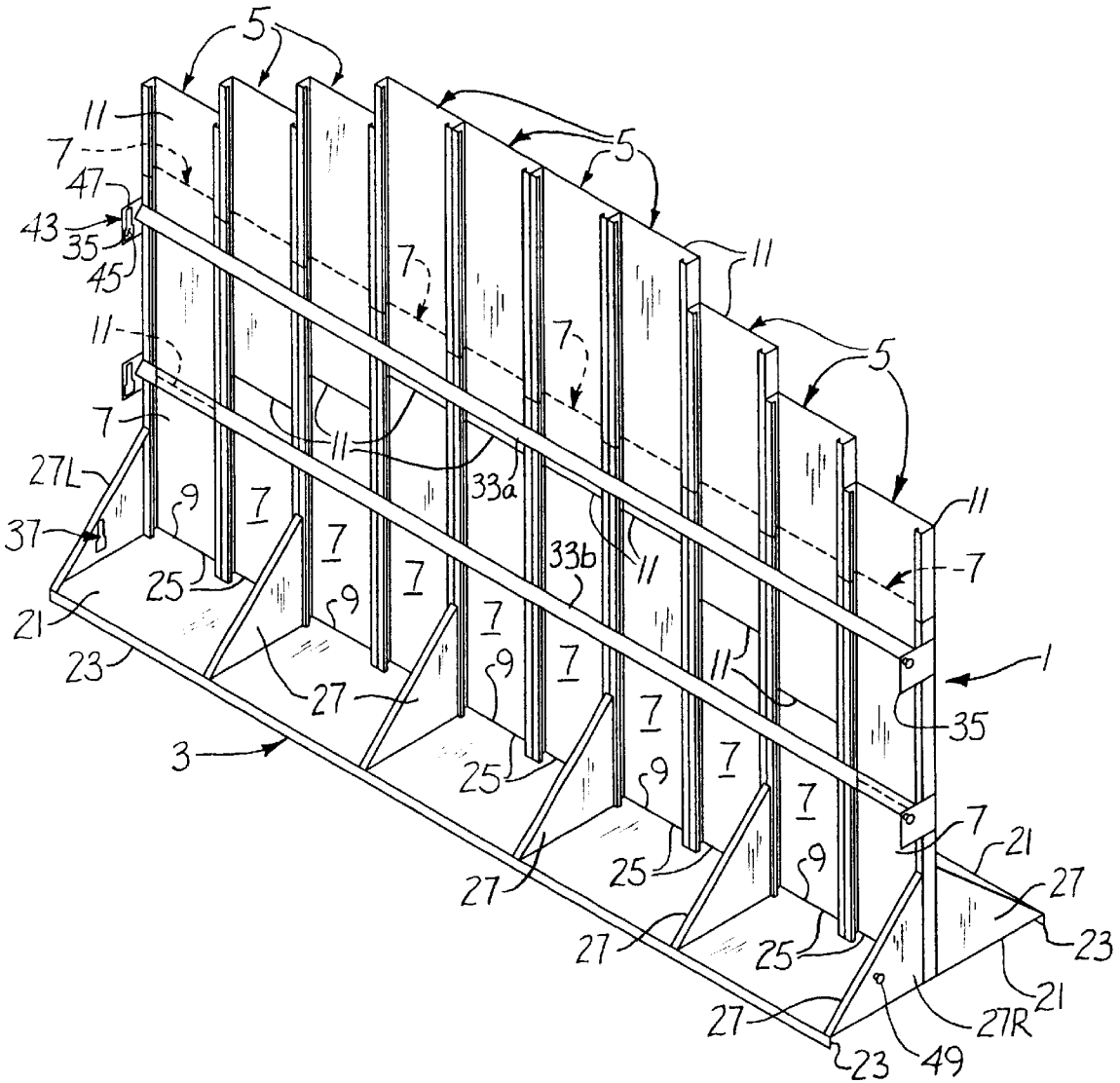
FIG. 1 is a semi-diagrammatic perspective illustrating a portable wall section per se of the invention.

Referring first to FIG. 1, a portable wall section of this invention, the section being designated 1 in its entirety, is a freestanding wall section comprising a base 3 adapted to rest on the floor of a passage in a mine and a plurality of elongate upright panels, each designated 5 in its entirety, extending up from the base in adjacent side-by-side relation. Note that the base may be omitted, as described below with respect to the embodiments of FIGS. 17–20. In the embodiment of FIG. 1, ten panels are shown, though the number of panels making up a section may vary. Each panel 5 is a vertically extensible panel preferably of the same type as detailed in FIG. 11 of the aforesaid U.S. Pat. No. 4,483,642 (the '642 patent) comprising a lower panel member 7 having its lower end 9 affixed to the base 3 and an upper panel member 11 extensible in an upward direction relative to the lower panel member for adjusting the overall height of each panel 5 to accommodate mine passages of different heights.

Figure 7:
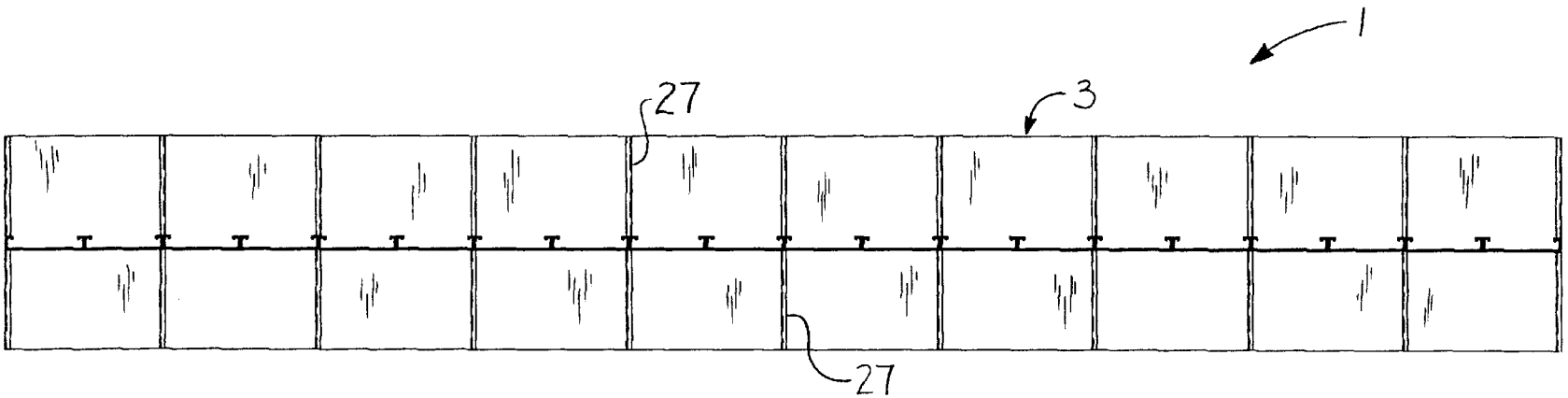
FIG. 7 is a semi-diagrammatic horizontal section generally on line 7—7 of FIG. 6, with the tie bars and connecting means being omitted for clarity.

In one embodiment, each of the lower and upper panel members 7, 11 is a sheet metal member of channel shape in horizontal cross-section (see particularly FIGS. 7 and 8) having a web 13 and flanges each designated 15 at opposite sides of the web. Each flange has an inturned portion 17 at its outer edge extending generally parallel to the web and a lip 19 at the inner edge of the inturned portion extending toward the web. The lips 19 of the upper panel member 11 extend beyond the lips 19 of the lower panel member 7. The upper panel member 11 has a telescoping fit in the respective lower panel member 7, the webs 13 of the members being in sliding sealing engagement. Other potential attributes may be ascertained from the referenced patents.

Figure 2:
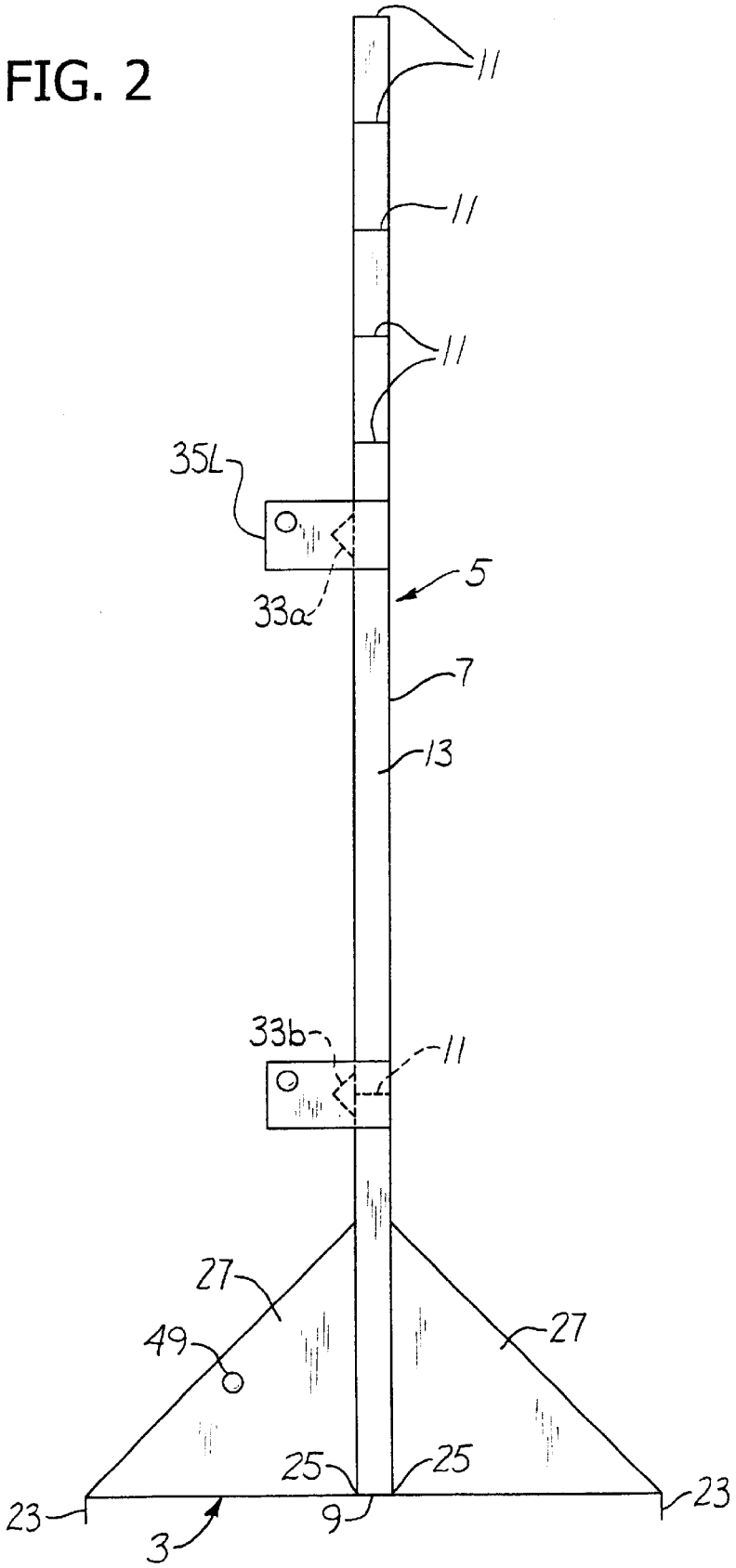
FIG. 2 is a semi-diagrammatic end elevation taken from the right of FIG. 1.

Referring to FIGS. 1 and 2, the base 3 comprises an elongate member generally of inverted channel shape in transverse cross-section thereby comprising horizontal web 21 and flanges 23 extending down from the web all along the lengthwise edges of the base for penetrating the floor of the mine passage (as will be subsequently detailed). The panels 5 extend up from the base in the stated side-by-side relation generally on the longitudinal center line of the base so that the base extends away in both directions from opposite faces of the array of panels, extending far enough to make the section 1 freestanding. The lower panel members 7 are affixed at their lower ends 9 to the base 3 as by welding indicated at 25, or by other suitable means (e.g., fasteners).

Bracing constituted by triangular sheet metal gussets 27 extends between the base and at least some (every other, as shown in this embodiment) of the junctures between lower panel members 7 to strengthen the section 1 for adding support to the panels 5 for maintaining them in vertical position. As shown, gussets are provided on both faces of the section generally in the vertical transverse planes of the outsides of both of the end panels of the section and the juncture of certain of the panels intermediate the end panels. For the section 1 made up of ten panels, there are six such triangular gussets, each of which may be flanged on all three sides and affixed to the base 3 and to the panels as by welding. Other types of bracing may be used to stabilize the upright panels 5 on the base 3. Preferably, the base 3 and gussets 27 are made of 14-gauge sheet metal, and the lower and upper panel members 7, 11 are made of 20-gauge sheet metal, though other gauges and materials other than sheet metal are contemplated.

Figure 8:
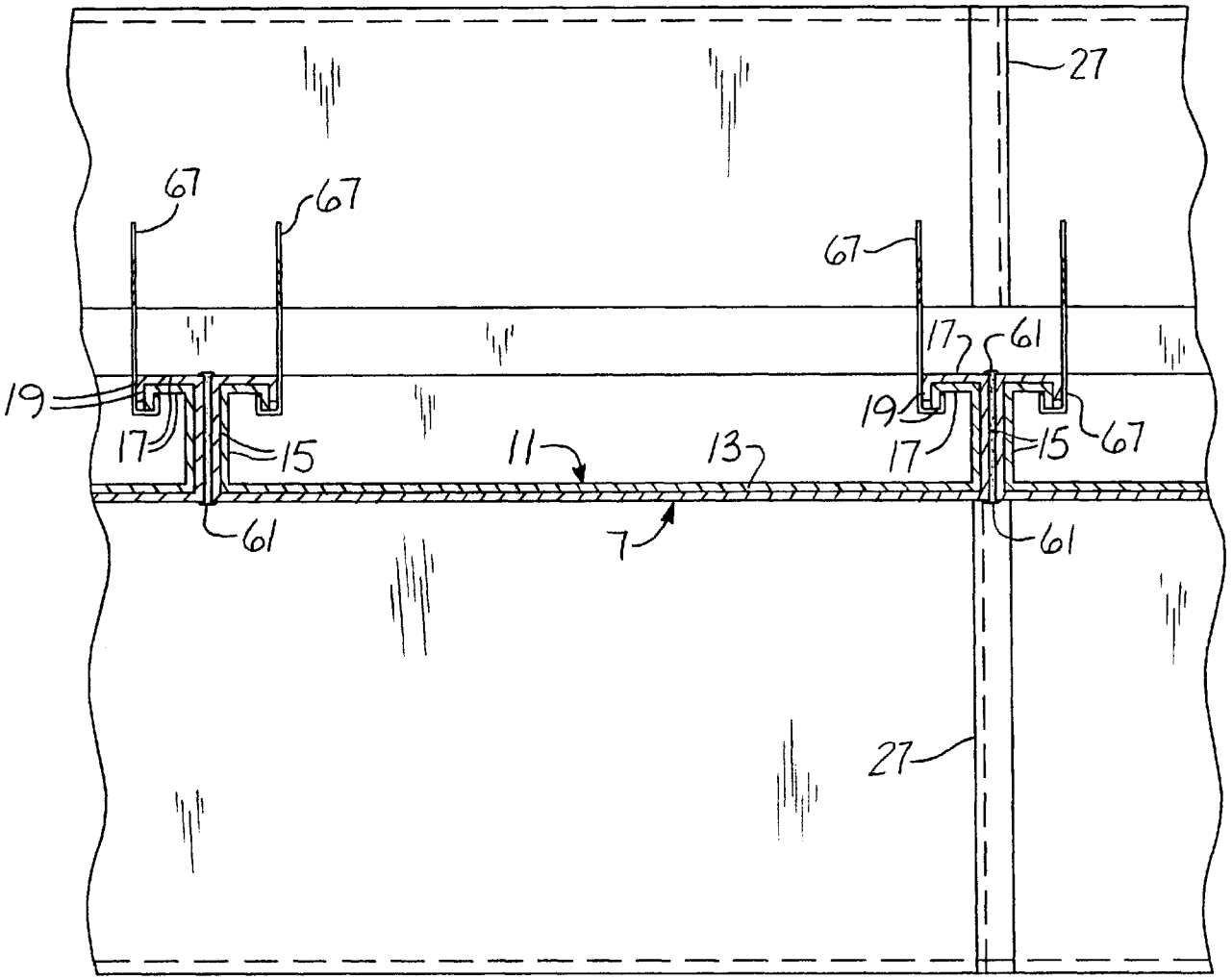
FIG. 8 is an enlarged detail of FIG. 7.

The panels 5 extend up from the base 3 with the flanges 15 of the side-by-side adjacent lower panel members in engagement one with the other. One or more tie bars extend transversely with respect to the lower panel members above the base from adjacent one side (end) of the section 1 to the other on the faces of the flanges 15 of the lower panel members 7. Two such tie bars are shown, one designated 33*a* adjacent the upper end of the array of the lower panel members, the other designated 33*b* being located at a level between 33*a* and the base 3. These tie bars (which may be lengths of angle iron) terminate adjacent the ends (sides) of the section 1 and are secured as by welding to the inturned portions 17 of the lower panel members, as shown in FIG. 8. A sheet metal tab 35 extends outward in a vertical plane from each end lower panel member 7 at each end of each tie bar, being secured in place as by welding.

Figure 3:
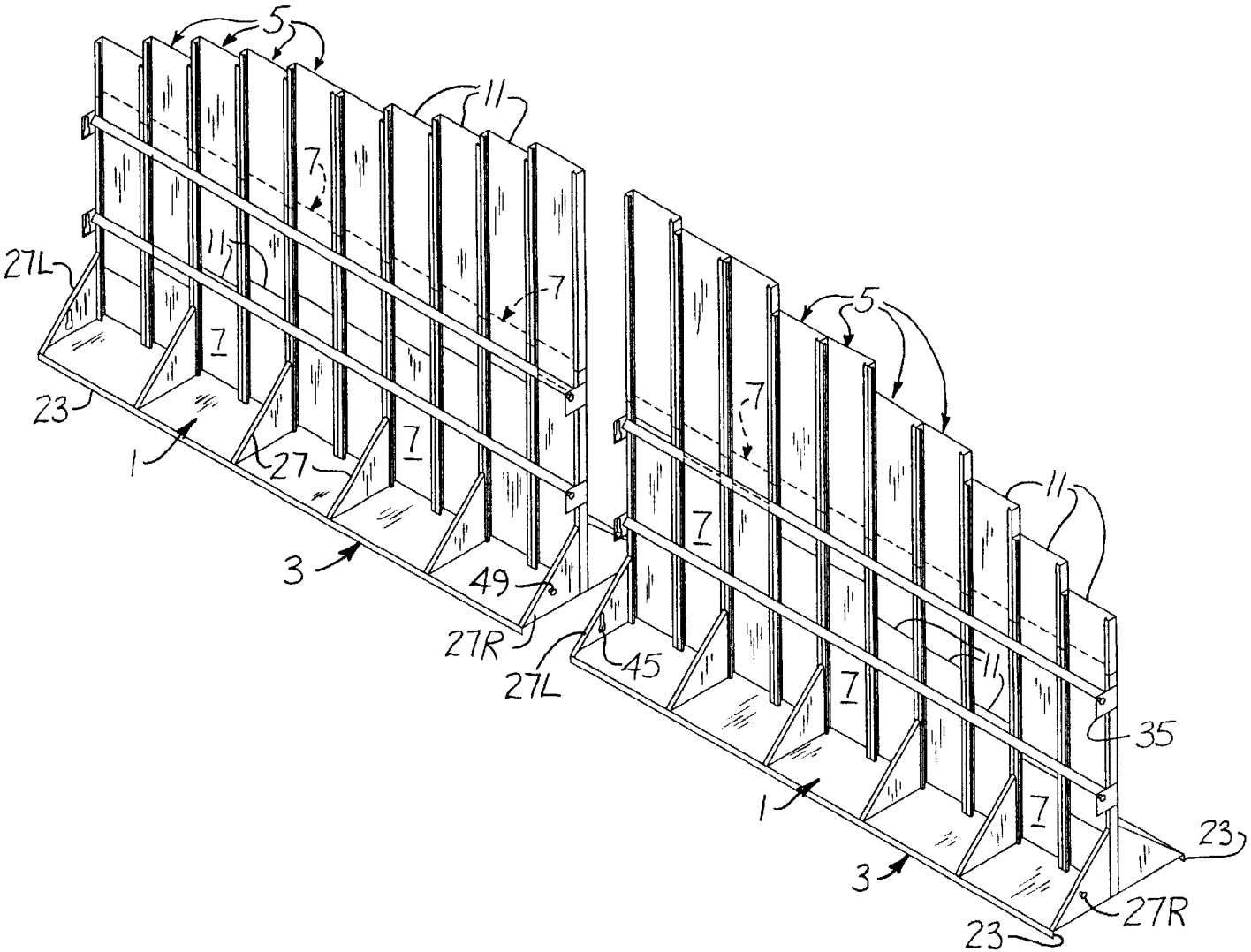
FIG. 3 is a semi-diagrammatic perspective illustrating the assembly of two of the sections shown in FIG. 1.

For quick-connection of a section 1 end-to-end with another section 1 (see FIG. 3), gusset 27L at the left end of section 1 (left end as viewed in FIG. 1) has a vertically extending bayonet slot 37 therein, the opening constituting the large end 39 of the slot being at its lower end and the relatively narrow part 41 of the slot extending up from large end 39. The tab 35L at the left end of section 1 has similar bayonet slot 43 having a corresponding large end 45 and upwardly extending narrow part 47. Gusset 27R at the right end of section 1 has a headed pin 49 extending outwardly at right angles thereto, the stem of the pin being indicated at 51 and its head being indicated at 53. Similarly, the tab 35R at the right end has a headed pin 55 extending outwardly at right angles thereto, the stem of pin 55 being indicated at 57 and its head indicated at 59.

Figure 4:
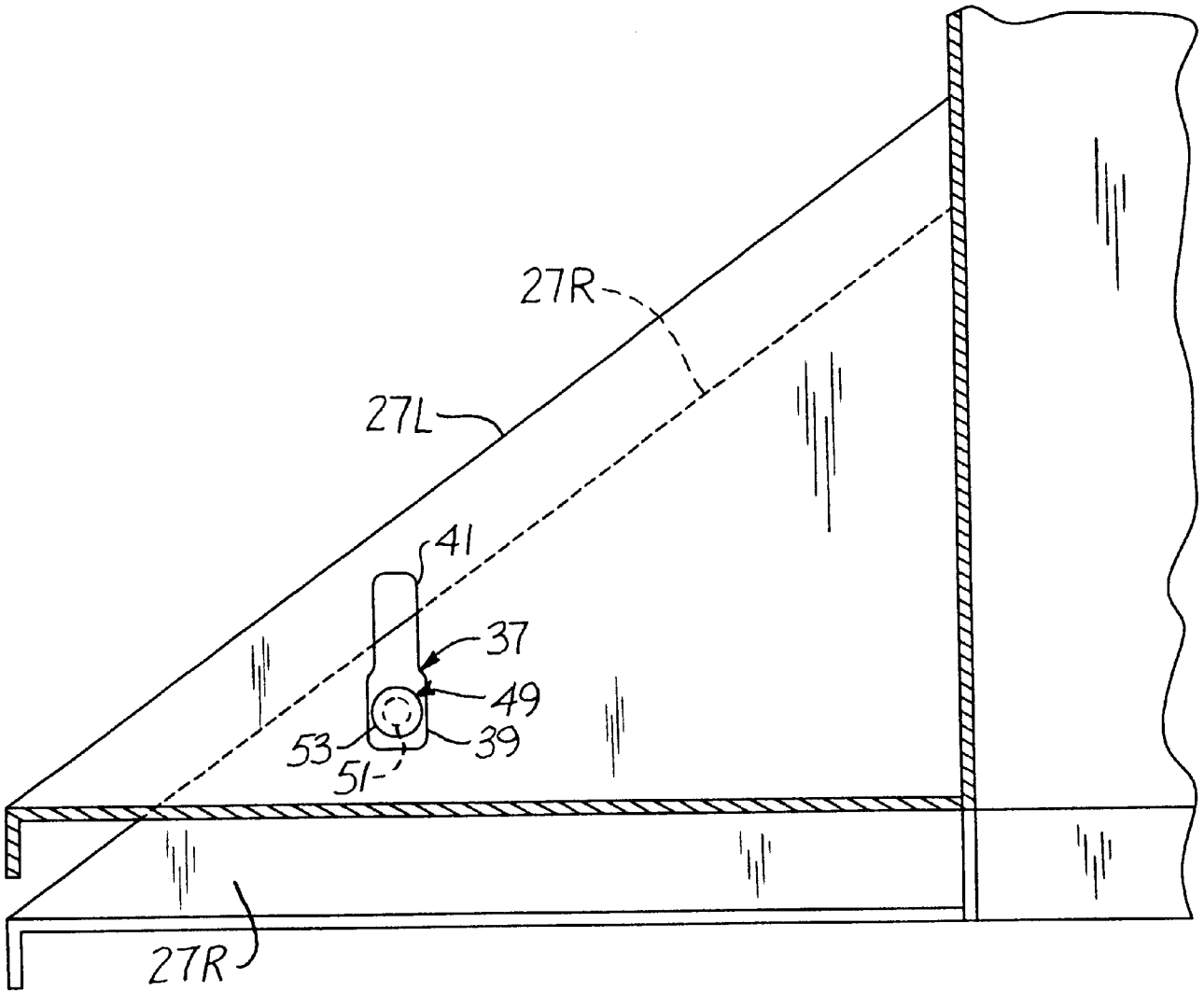
FIGS. 4 and 5 are enlarged details illustrating means for quick connection of the sections and how the quick connection is carried out.
Figure 5:
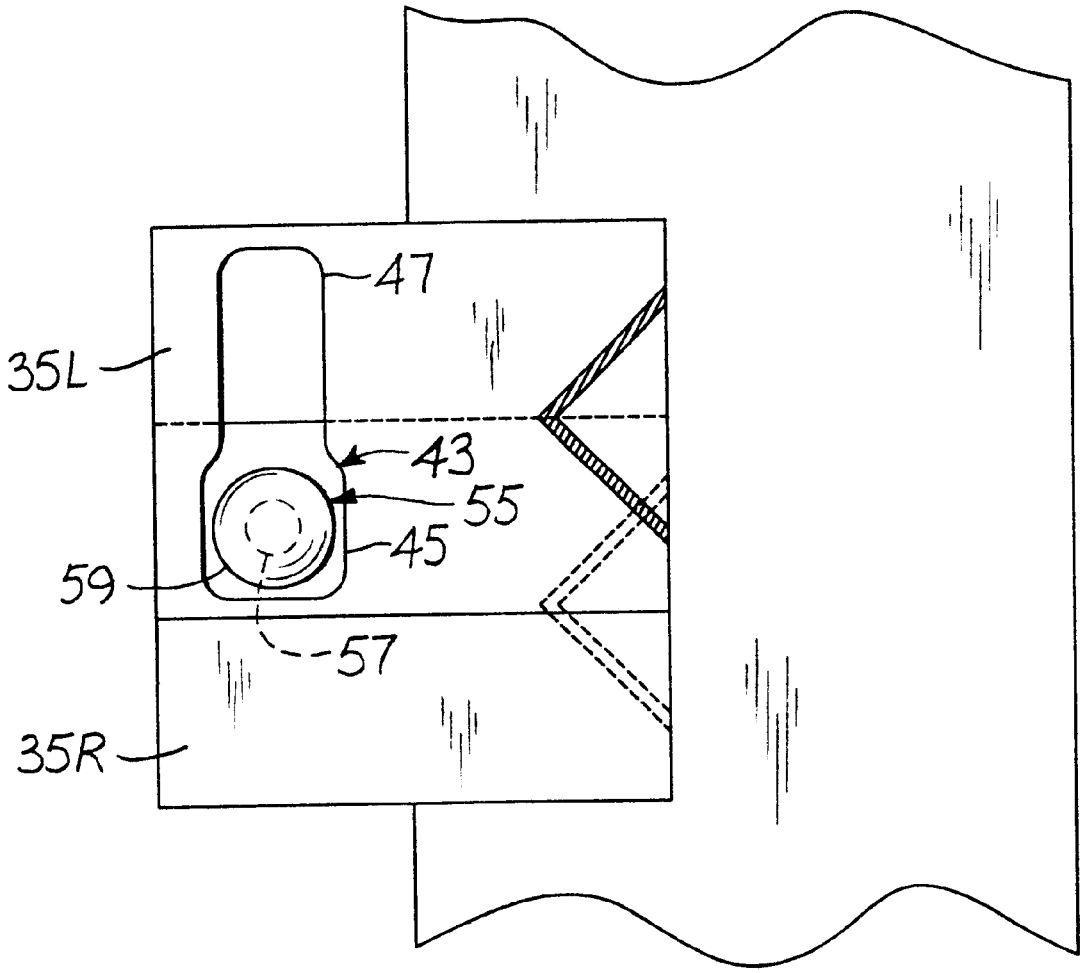
Figure 6:
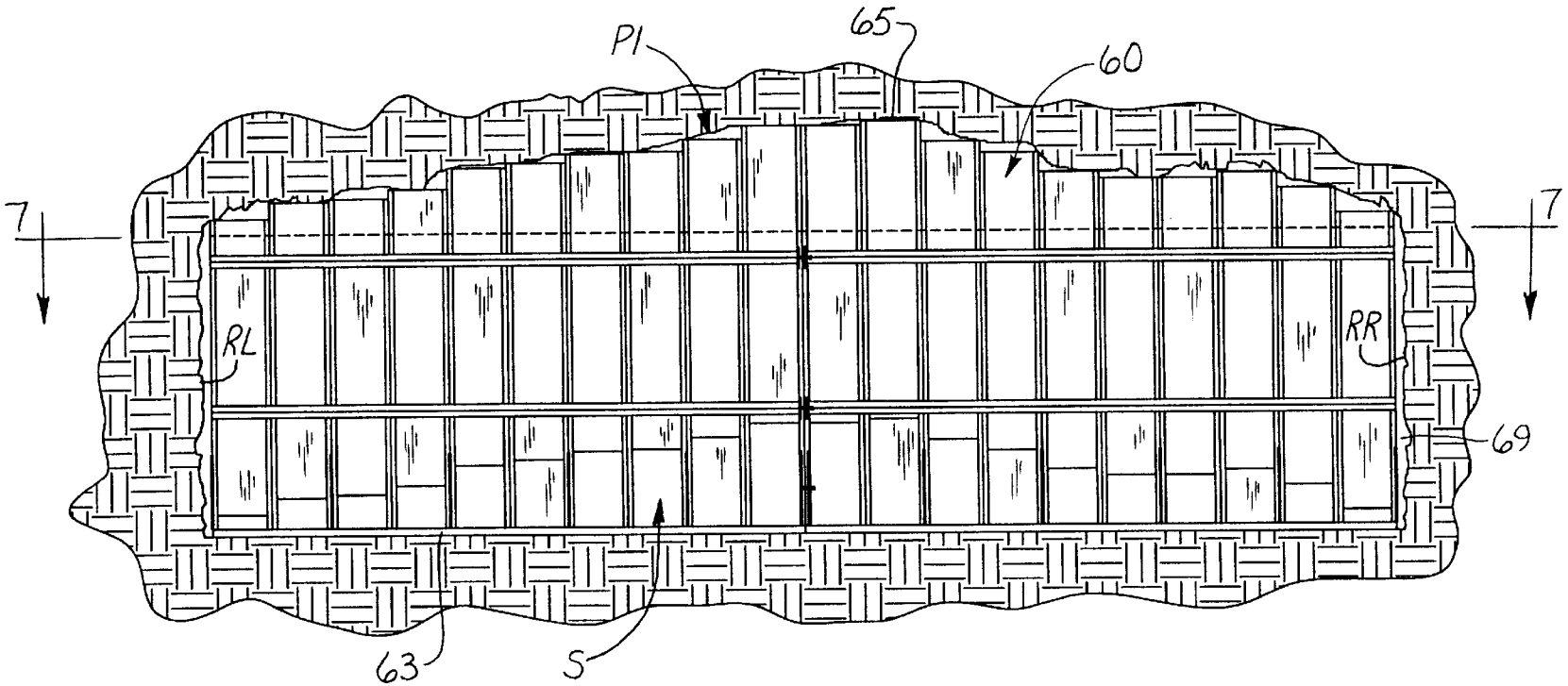
FIG. 6 is a view in elevation of one face of a completed stopping of the invention in a passageway in a mine, the floor, ribs and roof of the passageway being shown in section.

Each panel 5 is generally of such width that with ten panels side-by-side in a wall section 1 the section is somewhat less than half as long as the width of a typical mine passageway such as that shown in FIG. 6 and indicated at P1. Thus, two wall sections 1 arranged end-to-end will form a stopping such as indicated in its entirety by the reference character 60 extending across the passageway from adjacent one of the ribs of the passageway, e.g., the left-hand rib RL shown in FIG. 6, to the other rib, e.g., the right-hand rib RR shown in FIG. 6. Installation of the mine stopping comprising the two sections 1 at a site in a mine passage defined by floor 63, roof 65 and the opposing side ribs RL, RR involves bringing the sections to the site and positioning them generally end-to-end to extend across the mine passage. Referring to FIGS. 4–6, the left-hand section (with pins 49, 55 at its right end) is set up resting on the floor 63 of the passage with its base 3 on the floor and the panels 5 extending up from the base, the flanges 23 extending down from the base into furrows dug into the floor. The right-hand section (with bayonet slots 37 and 43 at its left end) is lifted into a raised position at the right of the left-hand section bringing the lower end openings 39, 45 of the bayonet slots at its left end into registry with the pins 49, 55 at the right end of the left-hand section 1, then moved to the left for engagement of the left end of the right-hand section 1 with the right end of the left-hand section 1 with accompanying acceptance of the pins in the bayonet slots. Then the right-hand section 1 is lowered, bringing its base 3 down on the floor 63 with the flanges 23 of the base extending down into furrows dug in the floor, and bringing the pins 49, 55 into the narrow positions 41, 47 of the bayonet slots, thus quickly effecting the end-to-end connection of the two sections 1.

Following the above-described placement and quick connection of the two sections 1, the upper panel members 11 of both sections are extended (e.g., jacked up as described in U.S. Pat. Nos. 4,695,035 and 4,483,642 which are incorporated herein by reference) to bring the upper ends thereof (which may be provided with head seals (which are omitted for clarity from the drawings) as in U.S. Pat. No. 4,820,081 which is incorporated herein by reference) into pressure engagement with the roof 65 of the mine passage P1.

The upper panel members 11 are suitably secured in their upwardly extending position by application of wire ties 67 (see FIG. 8, the wire ties being omitted for clarity in the other drawings) in the same manner as shown in U.S. Pat. No. 4,483,642 (especially FIG. 11 thereof) to the upper tie bar 33*a*. Wire ties may also be applied to the lower tie bar 33*b* where appropriate. It is to be understood that other clamping arrangements for securing the upper panel members in their upwardly extending position are contemplated. For example, the upper panel members may be secured to bracing, such as to bracing described below with respect to FIG. 12. As installed, the upper panel member 11 is preferably secured relative to the lower panel member 7 so that either panel member may telescope toward the other panel member in response to convergence of the mine roof and floor.

Preferably, the junctures between the lower panel members 7 and between the upper panel members 11 and between the sections 1 (i.e., whatever spaces there may be between abutting flanges of the panel members) are sealed as indicated at 61 in FIG. 8 by applying a sealant such as a flame-retardant latex, a polyurethane foam, plaster, mine sealant or other suitable material which adheres to the panels. The sealant may be troweled on, injected by an injecting gun as described in co-pending U.S. patent application Ser. No. 09/044,455, which is incorporated herein by reference, or otherwise suitably applied to substantially seal the junctures heightwise on both faces of the panels. Gaps such as indicated at 69 in FIG. 6 between the stopping and the side ribs of the mine passage may be similarly sealed. Note that gaps between the lower panel members 7 may be sealed prior to installation in the mine, e.g., during fabrication of the section at the factory.

Figure 6A:
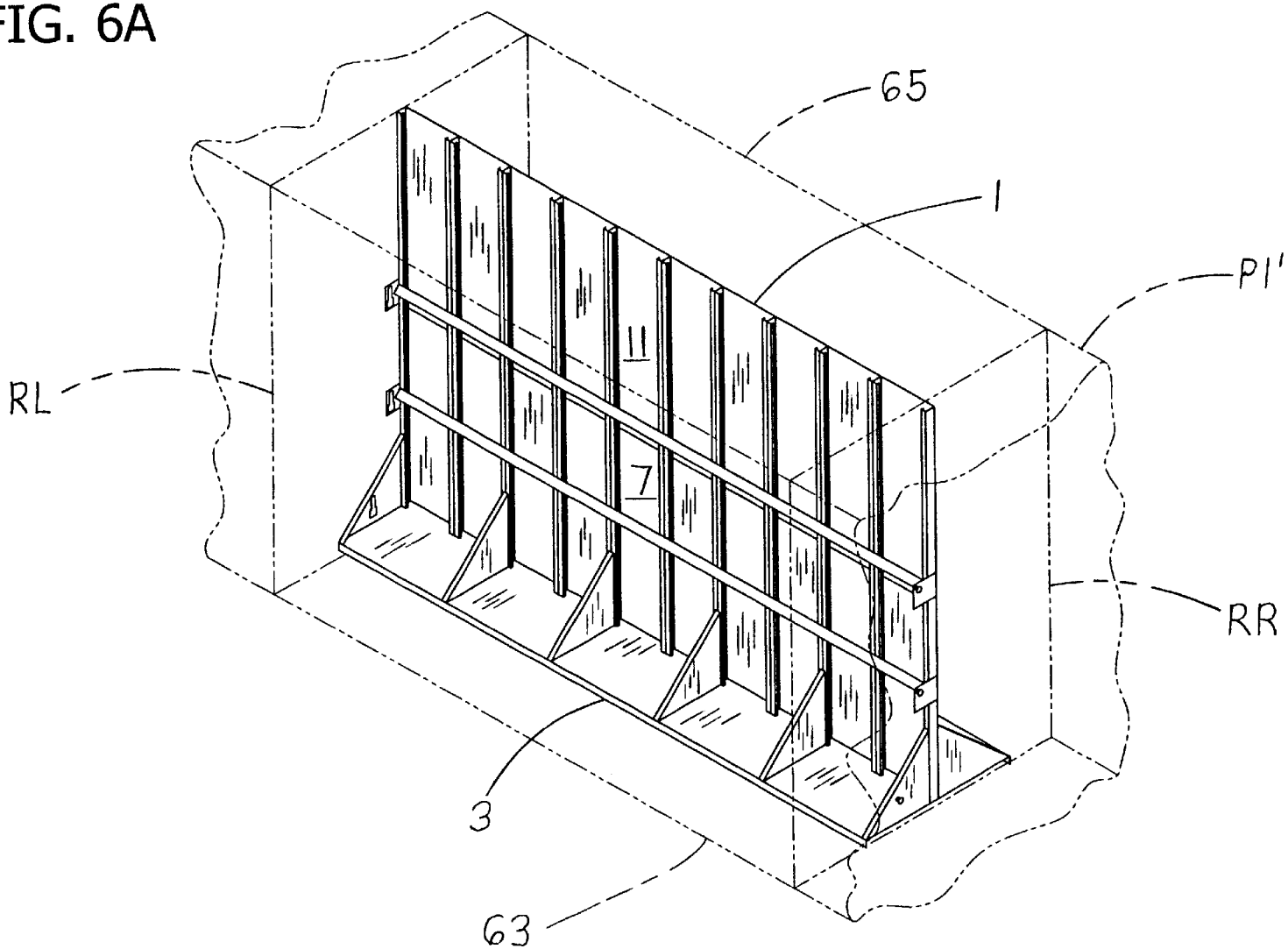
FIG. 6A is a semi-diagrammatic perspective illustrating an alternate embodiment in which the stopping comprises only one wall section, the floor, ribs and roof of the passageway being shown in phantom lines.

Thus, in one embodiment, the mine stopping system comprises a plurality (e.g., two) of the wall sections 1 which are portable to the site and means for connecting them, e.g., the quick-connection pin and bayonet slot connecting means. It is to be understood that the system may include any number of wall sections, and that other connecting means are contemplated as will be further described. As shown in FIG. 6A, a mine stopping of this invention may also include just one of the sections 1. In this embodiment, the wall section 1 is approximately as long as the width of a mine passageway such as that shown in FIG. 6A and indicated at P1'. Similar to the method described above, the section is positioned in the passageway P1', the upper panel members 11 are extended relative to the lower panel members 7 to bring the upper panel members into pressure engagement with the roof of the mine passageway, the upper panel members are secured relative to the lower panel members in extended position, and gaps between the panels and between the section 1 and the side ribs of the mine passage are suitably closed. For example, the gaps may be sealed as described above, and the gaps between the section and the ribs may also be closed by use of extensions described below with respect to FIG. 9.

Figure 17:
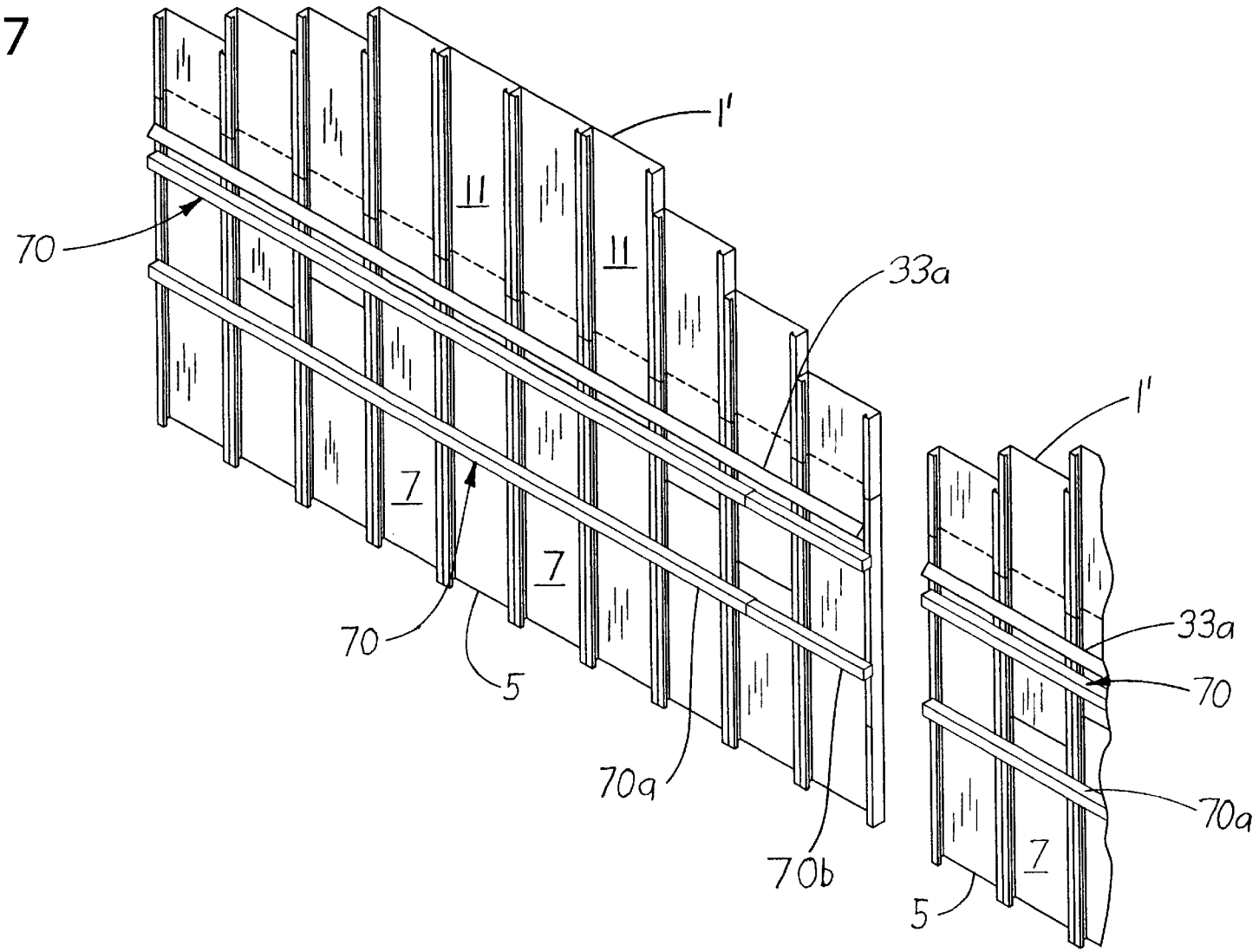
FIG. 17 is a semi-diagrammatic perspective similar to FIG. 1 showing another embodiment of the wall section.

Referring to FIG. 17, in another embodiment portable section 1' does not include a base and thus is not a free-standing assembly. The panels 5 of section 1' are secured in adjacent side-by-side relation by an elongate element such as a tie bar 33*a* and by reinforcing braces generally designated 70, the panels being secured to the tie bar and reinforcing braces by welding. Note that the panels may be secured only by tie bars, or only by reinforcing braces, or by other types of elongate elements. Also, other means of securing the elongate elements to the panels are contemplated. For example, suitable reinforcing braces and trusses described in co-pending U.S. patent application Ser. No. 09/464,808, which is incorporated herein by reference, could be used to secure the panels in side-by-side relation.

In the illustrated embodiment, each brace 70 includes an elongate central member 70*a* and an elongate end member 70*b*. Preferably, only the central member 70*a* is fixed to the panels, the elongate end member being free to move relative to the central member and the panels. In one embodiment, the members 70*a* and 70*b* are of rectangular cross-section, but they may have other suitable shapes. For example, the central member 70*a* may be shaped like an I-beam in cross-section, the I-beam having its web extending perpendicular to the panels 5 for reinforcing the stopping against air pressure. Further, the end member 70*b* may be made of solid stock material and may have shapes other than rectangular, including a channel-shape. The end member 70*b* is of sufficient length that it can be extended substantially beyond the right end of the section 1' (as viewed in FIG. 17) into a central member 70*a* of an adjacent section 1' for connecting the sections.

To construct a stopping comprising two sections 1', the sections are positioned side-by-side and held upright in the mine passageway. The sections 1' are secured in upright position by extending the upper panel members 11 into pressure engagement with the roof of the passageway and securing the upper panel members to the tie bar 33*a* (e.g., by jacking and then clamping as described above; note that the ties 67 are omitted from FIG. 17 for clarity). The sections 1' are suitably connected by extension of the telescoping end member 70*b* of the left section (as viewed in FIG. 17) into the central member 70*a* of adjacent right section 1'. The telescoping end member 70*b* may also be secured to the central member 70*a,* as by a fastener or other means. Note that the order of the steps may be changed, i.e., the sections may be connected and then the upper panel members extended. It is contemplated that section 1' also be connected to adjacent sections by other means. Connecting the sections 1' by extension of the telescoping end member 70*b* is advantageous in that the stopping is better reinforced to withstand significant air pressure exerted on the stopping. The stopping is suitably sealed as described above.

Figure 18A:
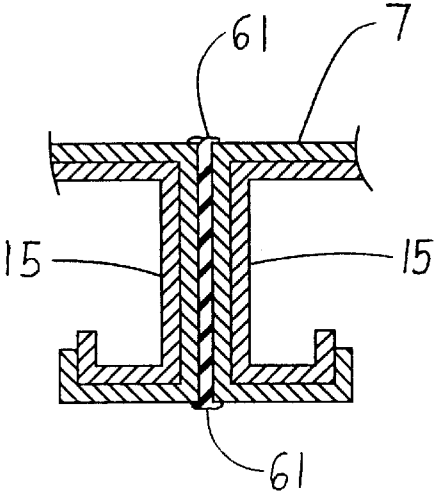
FIG. 18A is a fragmentary section view taken along line 18A—18A of FIG. 18.
Figure 18:
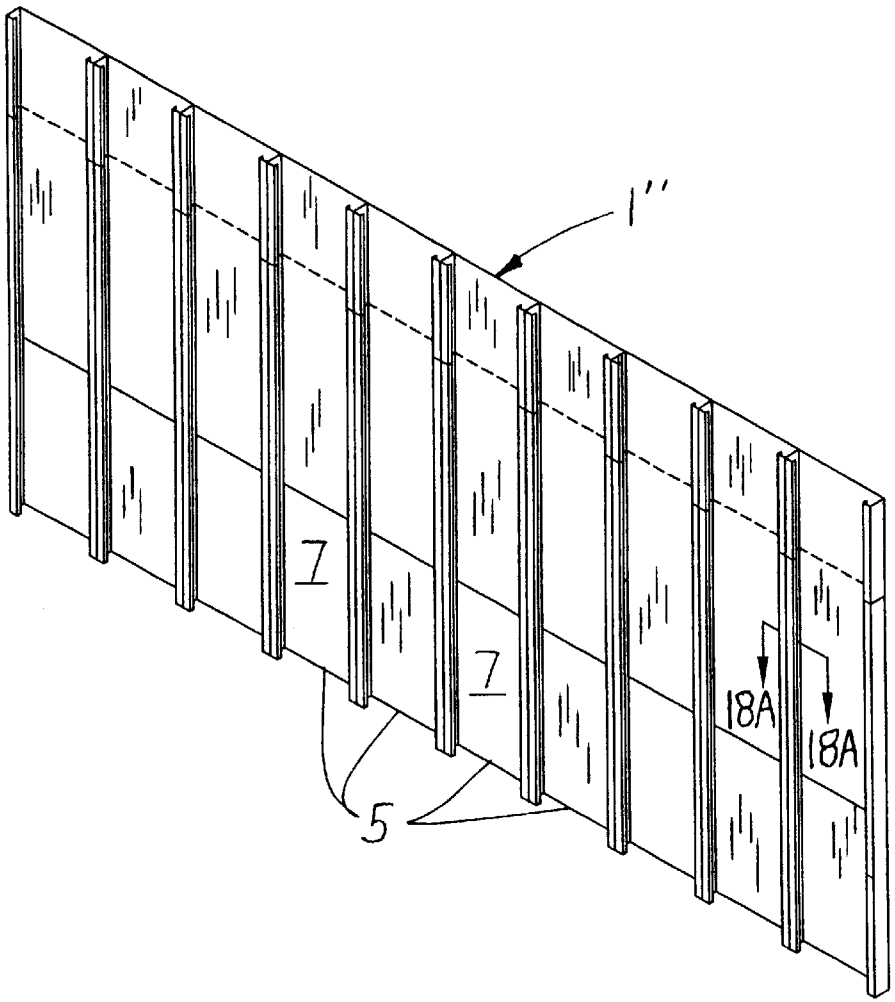
FIG. 18 is a semi-diagrammatic perspective similar to FIG. 17 showing another embodiment of the wall section.

Referring to FIG. 18, a section 1" is similar to section 1' except that the panels 5 are fastened together, preferably prior to introduction to the mine, e.g., at the factory, by a strong adhesive rather than one or more elongate elements. Preferably, a polyurethane foam sealant 61 as described above and shown in FIG. 8 is injected between the flanges 15 of the side-by-side adjacent lower panel members 7 to bond the members together. The section 1" is installed as described with respect to section 1' and may be connected to another section by any of the means described herein.

Figure 19:
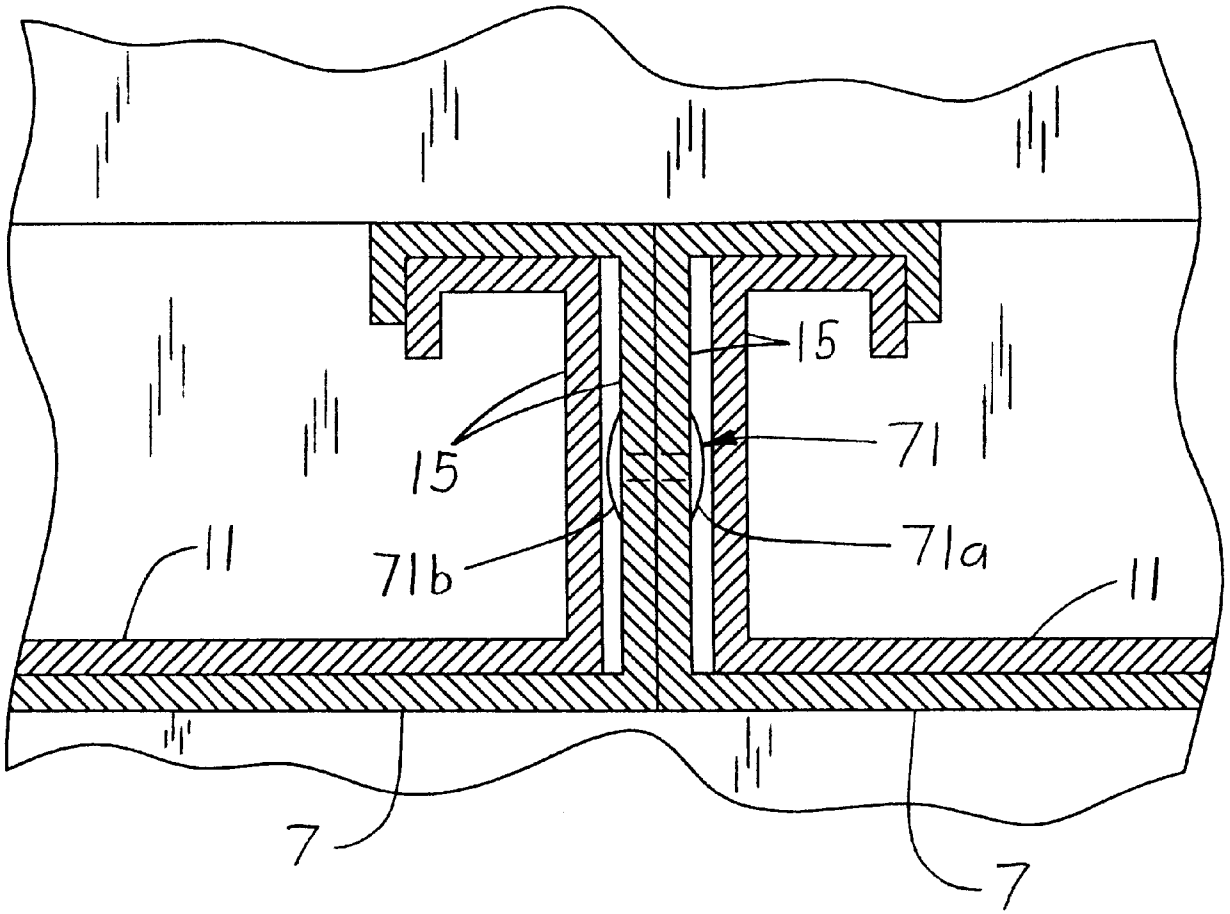
FIG. 19 is a fragmentary section view similar to FIG. 8 showing another embodiment of the wall section.

Referring to FIG. 19, panels of a portable section may also be connected by rivets generally designated 71. Note that use of other types of fasteners is contemplated. As shown, sufficient space is provided between flanges 15 of the lower panel members 7 and upper panel members 11 so that the head 71*a* and the opposite end 71*b* of each rivet 71 do not interfere with telescoping motion of the upper panel member.

Figure 20:
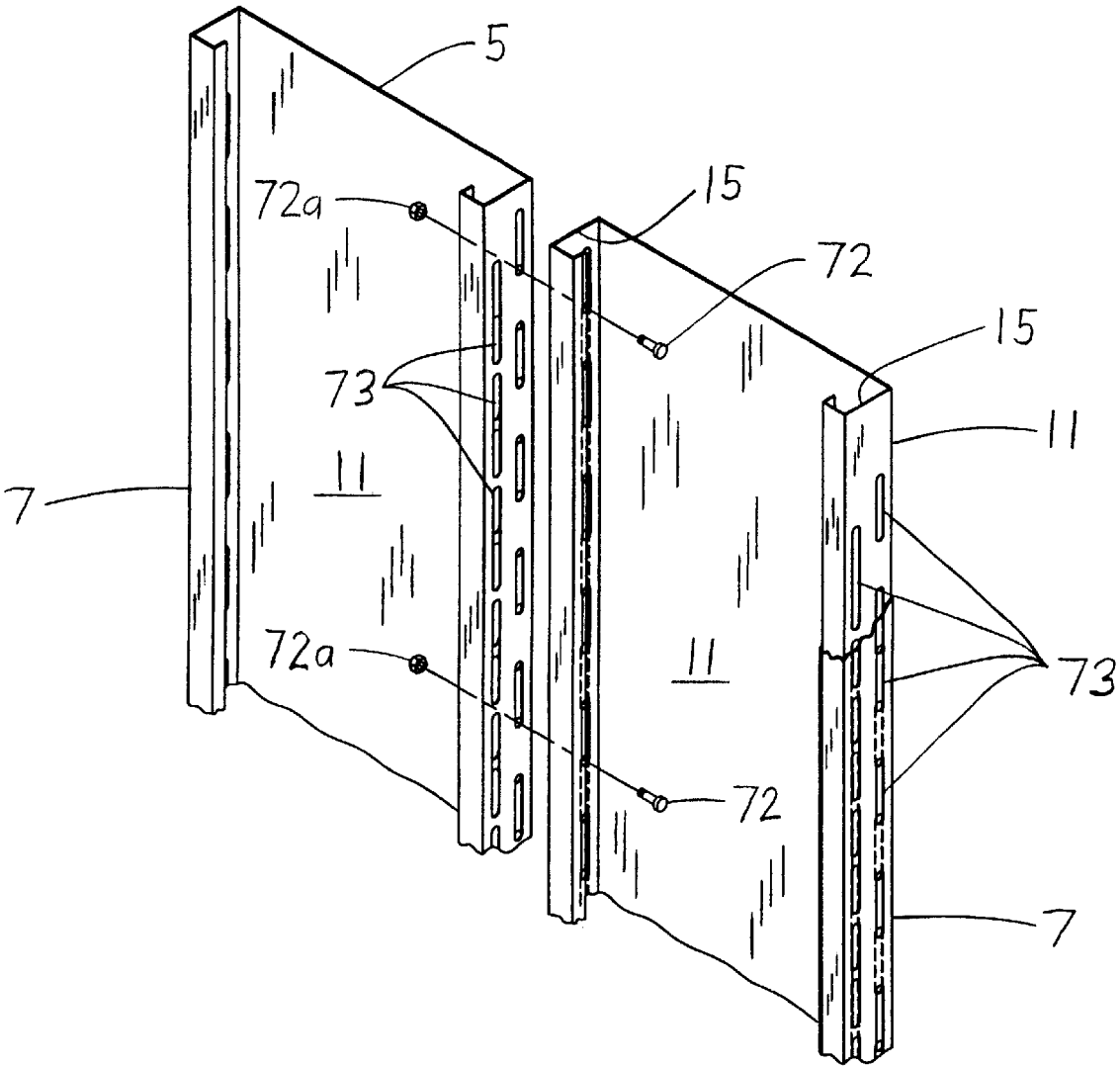
FIG. 20 is a fragmentary perspective of slotted panels of another embodiment of the wall section.

In the embodiment of FIG. 20, adjacent panels 5 of a wall section are secured together by bolts 72 extending through slots 73 in the flanges of the panels, and by nuts 72*a* threaded on the bolts. Preferably, two parallel columns of vertical slots 73 are formed in the flanges 15 of the lower and upper panel members 7, 11, the arrangement being such that the slots in the upper panel member overlap the slots in the lower panel member. The slots 73 in the panel members have about the same width as the diameter of the bolt 72, and are of sufficient length so that the upper panel member 11 can be extended at least partway relative to the lower panel member 7 when the bolt and nut are loosened. A wall section made from such panels would be installed in substantially the same way as described above with respect to section 1', except that bolts 72 may need to be removed from the slots 73 to facilitate greater extension of the upper panel member 11 relative to the lower panel member during jacking of the upper panel member. In such case, after the upper panel member is jacked up into pressure engagement with the roof, the bolts 72 may again be inserted through the slots 73 and nuts 72*a* threaded on the bolts to help secure the upper panel member 11 relative to the lower panel member 7. Alternatively, the upper panel members 11 may be clamped to tie bars 33*a,* 33*b* as described above.

Figure 9:
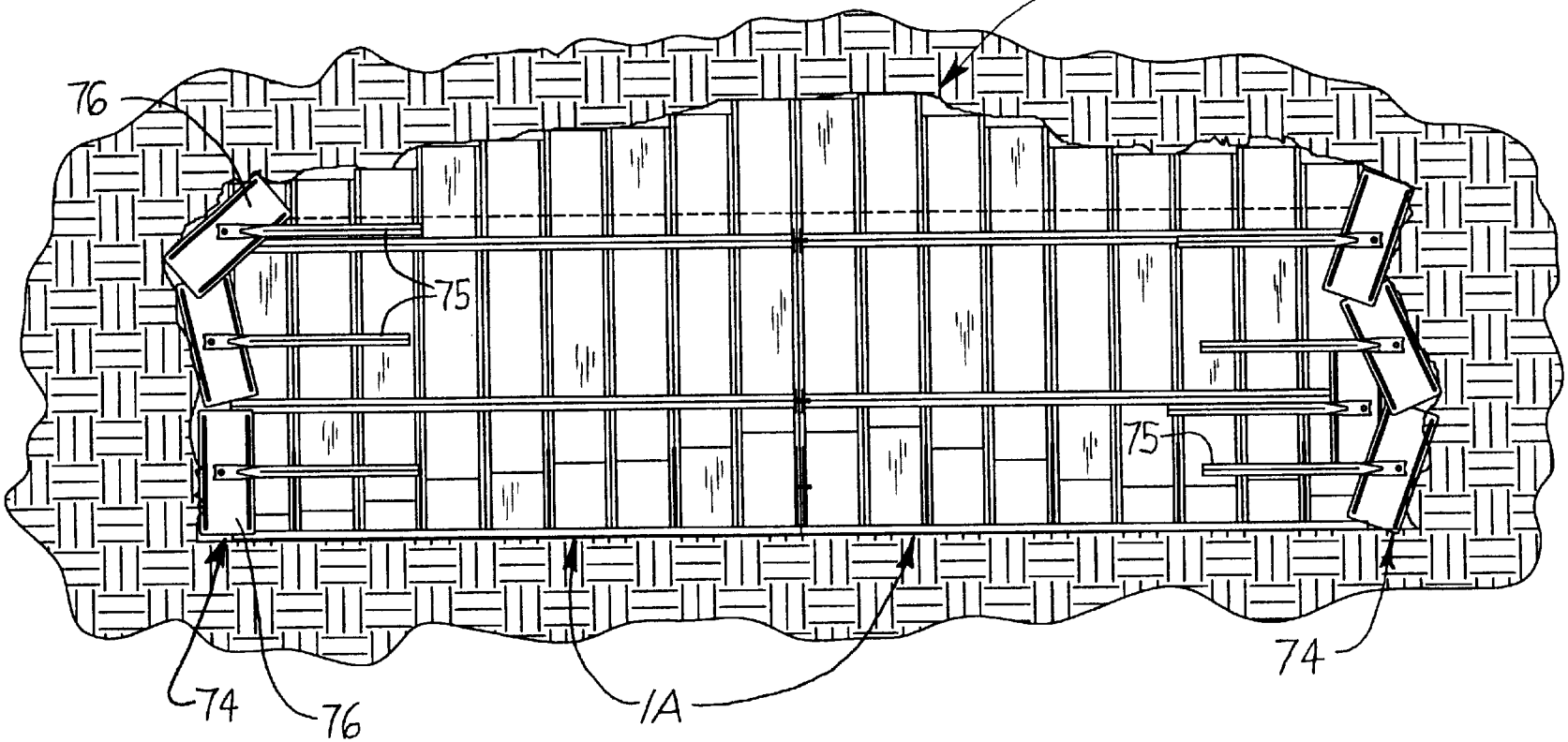
FIGS. 9, 10 and 11 are views similar to FIG. 6 showing modified versions of the stopping, FIGS. 10 and 11 being in part broken away.

Referring to FIG. 9, spaces between the stopping and the ribs of a passageway P2 are suitably covered by the provision of side extensions 74 including bars 75 and plates 76 in a manner similar to that shown in U.S. Pat. No. Re. 32,871, except that the plates are oriented, for example, as appears in FIG. 9 rather than extending horizontally. Two nine-panel sections 1A (rather than ten-panel sections) are shown for variety. The stopping shown comprises sections 1, though the extensions may be used in any of the stoppings or stopping forms described herein.

Figure 10:
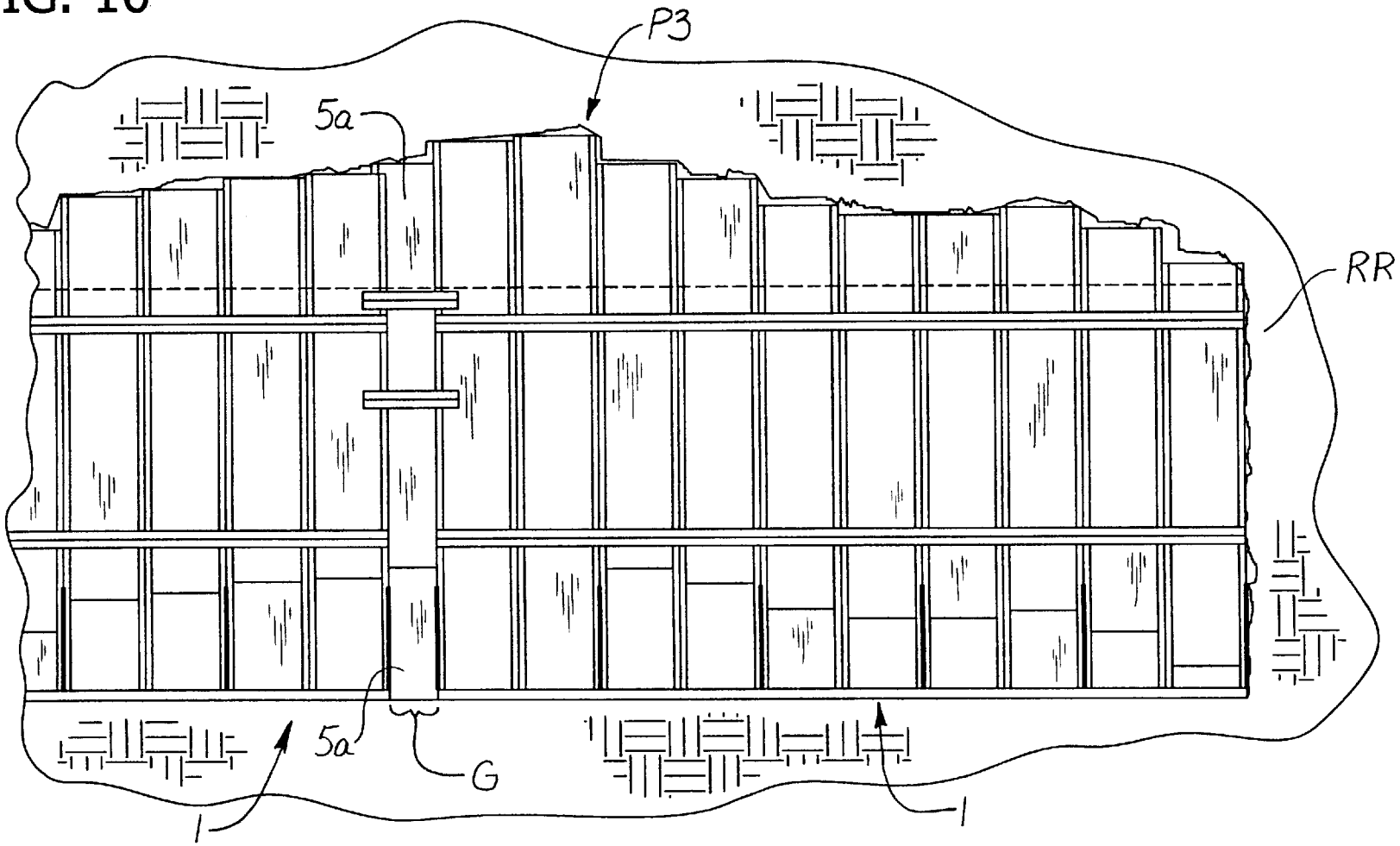

FIG. 10 illustrates another variation which may be installed in a passageway P3. Here two exemplary sections 1 are spaced apart endwise, forming a gap G between the two sections. Instead of connecting the sections by means of the pins and bayonet slots (which are not used here), connecting means comprising one or more (one being shown) elongate vertically extensible panels 5*a* positioned to bridge the two adjacent sections and close the gap therebetween similar to the lap-over panel system shown in U.S. Pat. No. 4,484,837, which is incorporated herein by reference.

Figure 11:
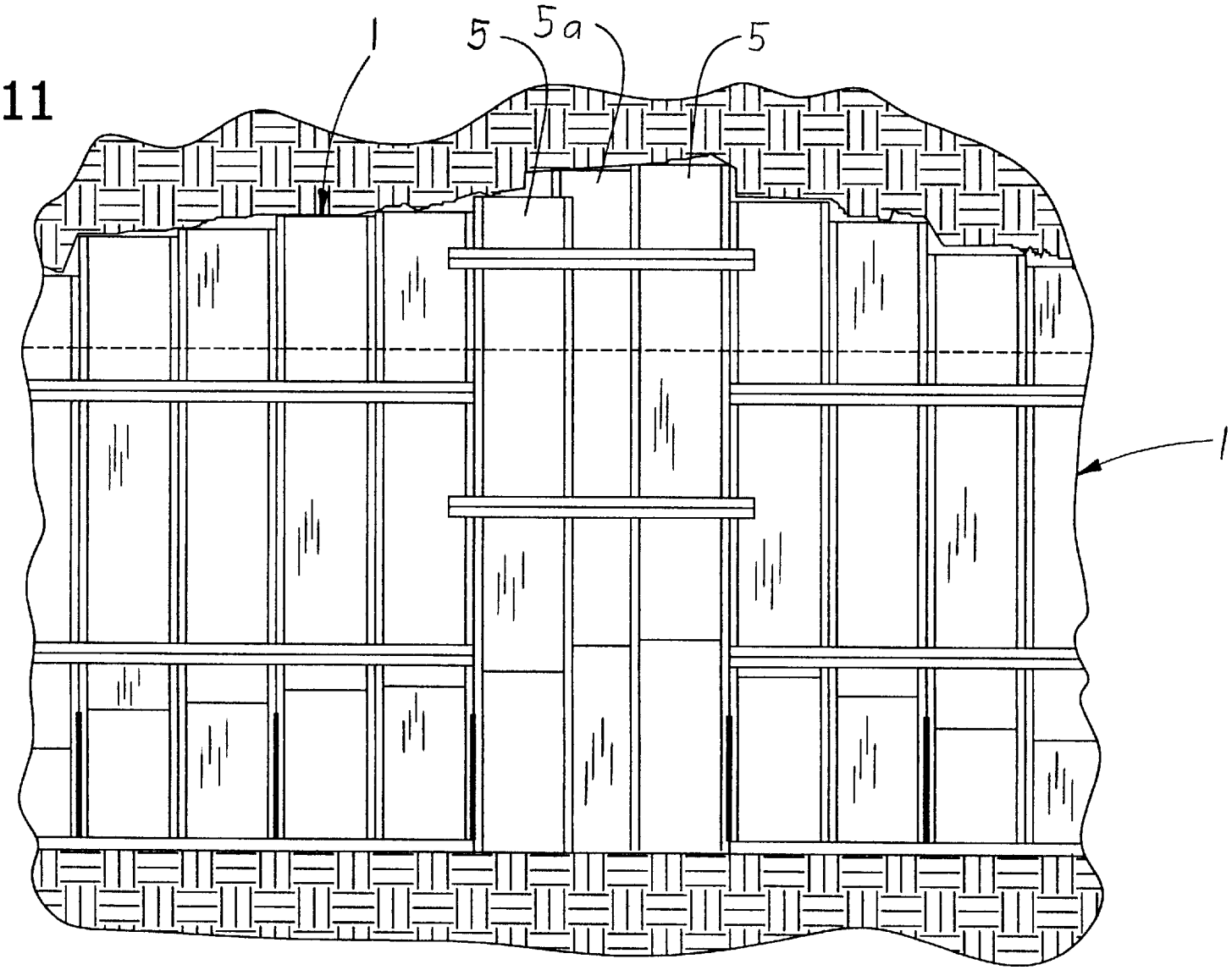

FIG. 11 illustrates another variation similar to the FIG. 10 variation having two extra panels 5 provided between the panels 1 as well as the lap-over panel 5*a*.

Figure 14:
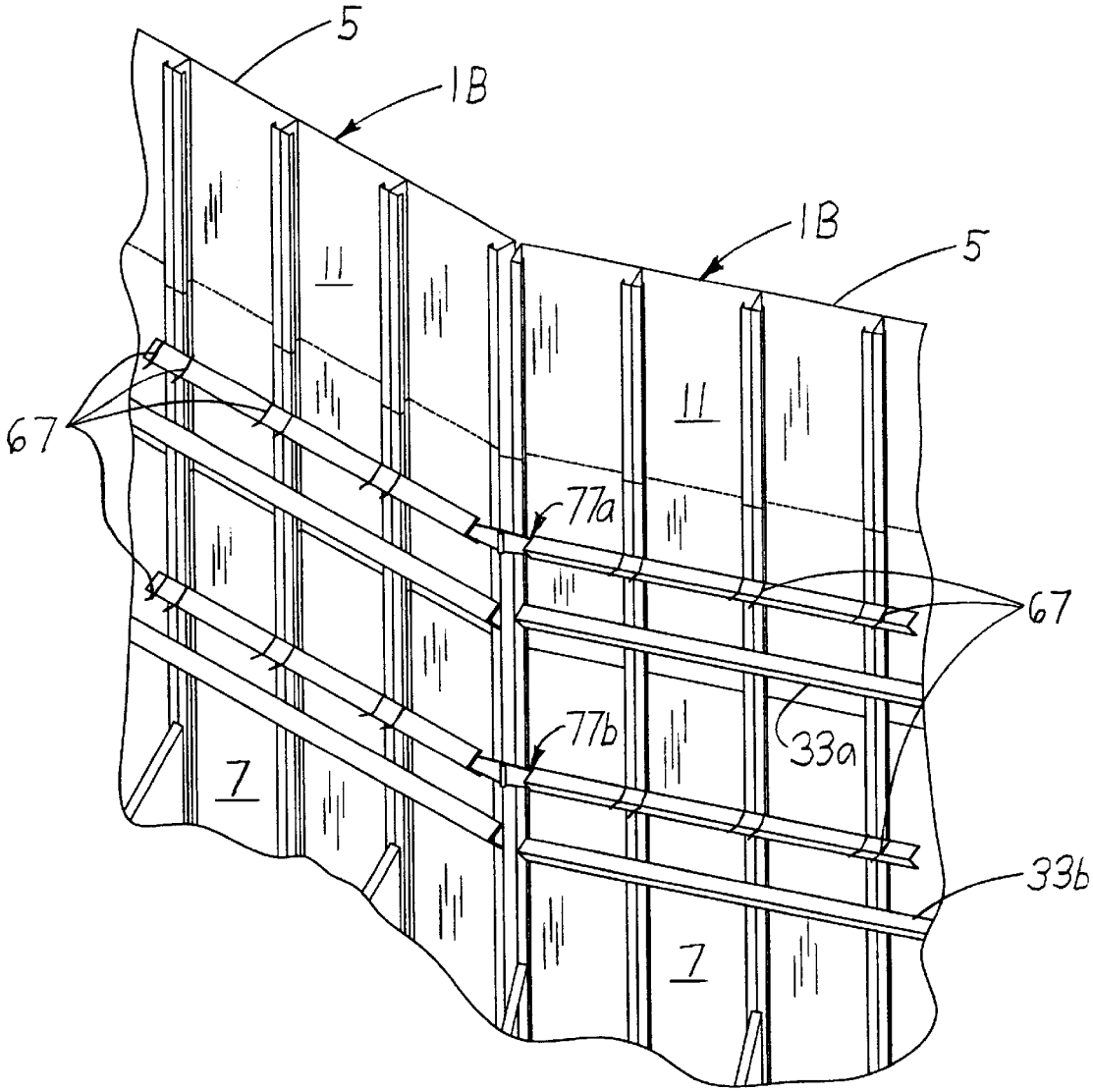
FIG. 14 is a fragmentary perspective of sections joined by hinges.
Figure 15:
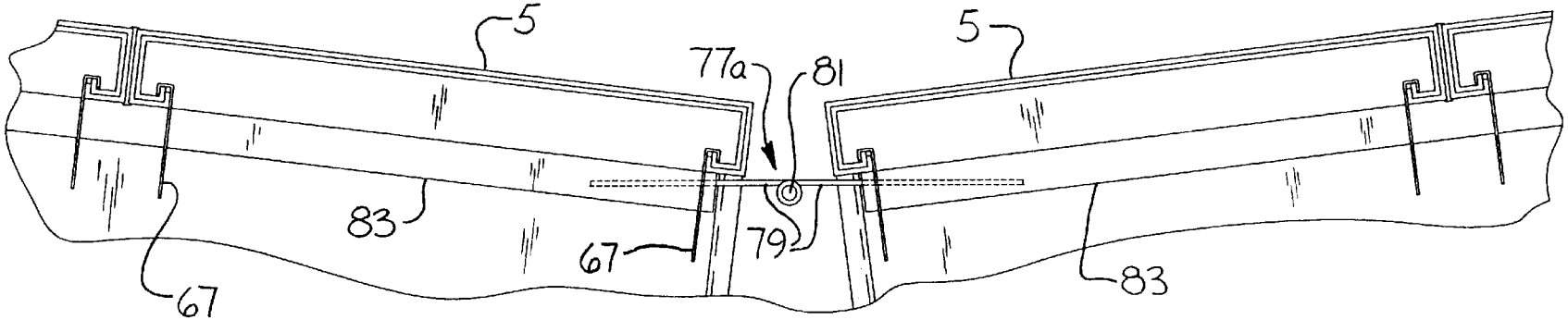
FIG. 15 is a fragmentary top view of the sections of FIG. 14.
Figure 16:
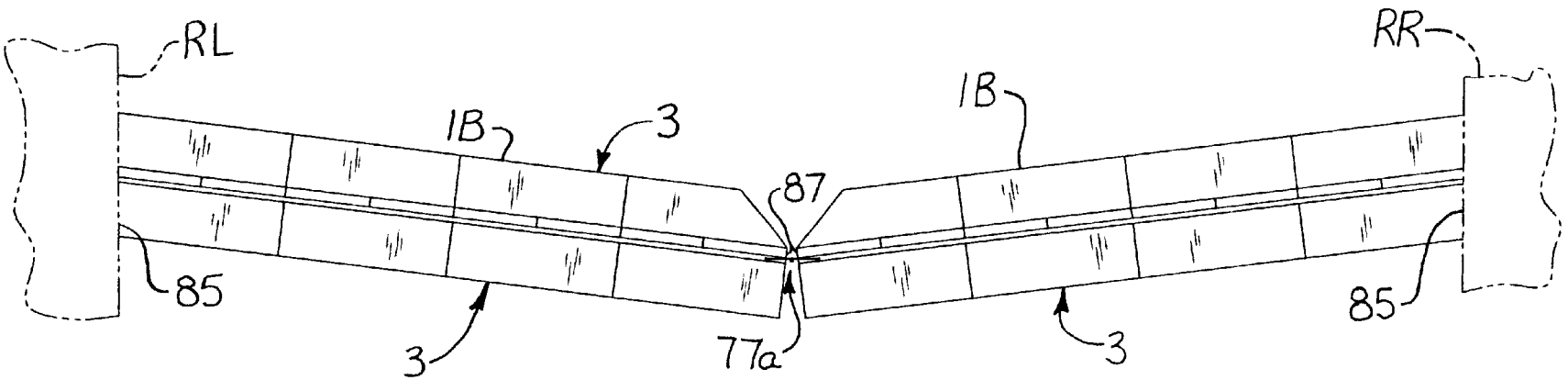
FIG. 16 is a semi-diagrammatic top view of the sections of FIG. 14 installed in a passage.

FIGS. 14–16 illustrate two sections 1B connected by upper and lower hinge assemblies 77*a,* 77*b* secured to the sections after the sections are positioned in the mine passageway. Each hinge assembly comprises two tie bars 83 (similar to tie bars 33*a,* 33*b*) and a hinge including a pair of elongate mating hinge plates 79 joined by a hinge pin 81, the hinge plates being affixed, as by welding, to respective tie bars 83. The tie bars 83 are suitably secured to the panels 5 of respective sections 1B such as by wire ties 67 of the type described above. The tie bars 83 of the upper hinge assembly 77*a* extend less than the full length of the section 1B. However, the tie bars 83 may extend the full length and may be secured to the panels after the upper panel members 11 are extended upward into engagement with the roof so that the hinge assembly serves both to connect the sections and to hold the upper panel members in upwardly extended positions. In such case, the tie bars 83 may be used instead of tie bars 33*a,* 33*b*. Alternatively, the tie bars 83 may be secured (e.g., welded) to the lower panel members 7 at the factory similar to sections 1 described above. Thus, the two sections 1B may be connected before being transported to the mine. As a further variant where the hinge assemblies are attached to the sections 1B prior to transport to the mine, the two sections 1B may be transported to the mine separately by removing the hinge pins 81 and then replacing the hinge pins after the sections are positioned in the mine passageway. Preferably, the outward end 85 of one section 1B engages or is immediately adjacent rib RL and the outward end 85 of the other of the sections 1B engages or is immediately adjacent opposite rib RR. As shown in FIG. 16, the sections 1B may be angled with respect to one another with their adjacent ends 87 at the center of the passageway engaged or positioned immediately adjacent one another so that gaps between the sections can be readily sealed as described above. Note that other means of attaching the hinges to the sections are contemplated, such as attaching the hinge plates 79 directly to sides of the end panels 5 of the two sections 1B being connected.

Figure 12:
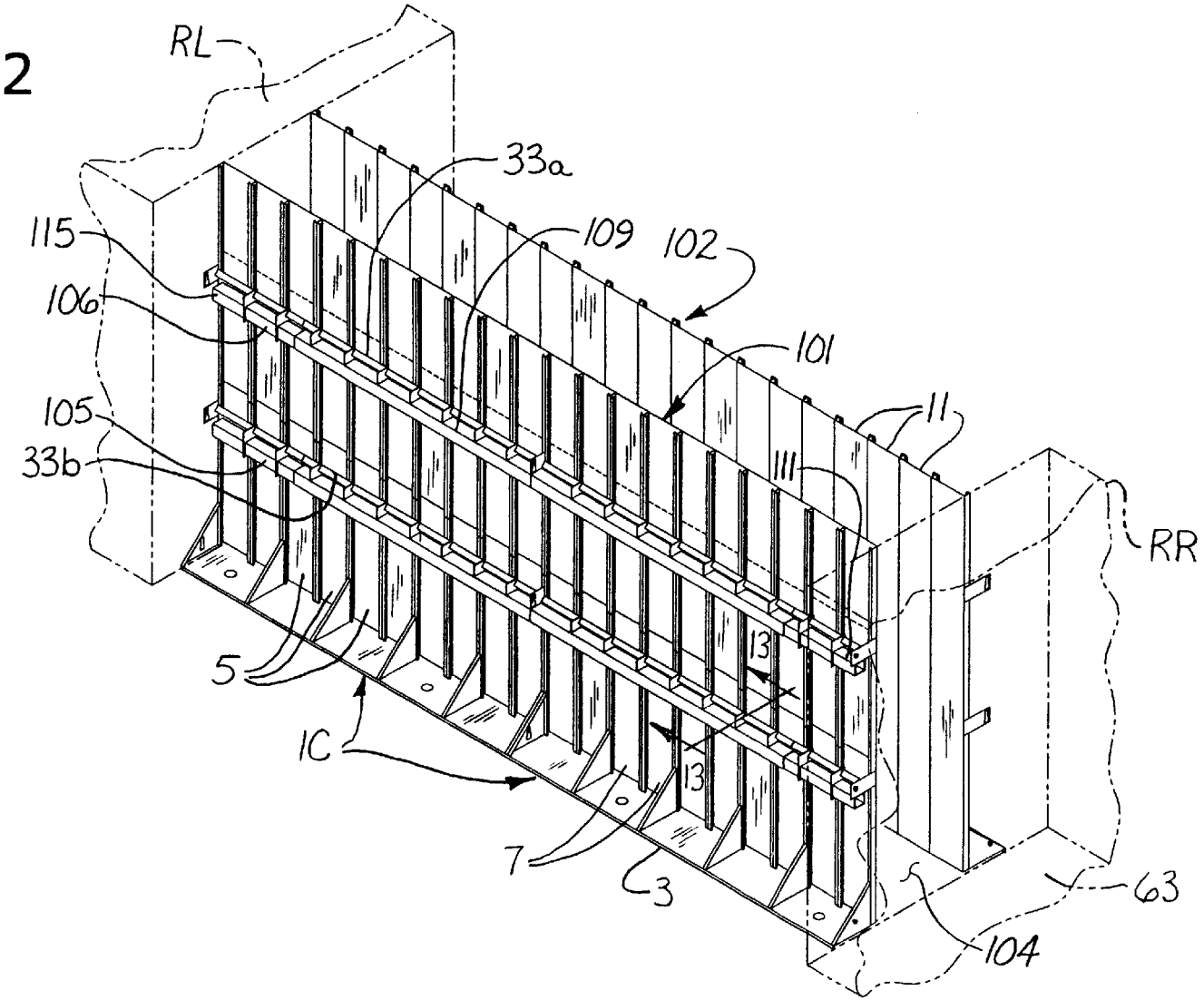
FIG. 12 is a semi-diagrammatic perspective of a permanent stopping form of the invention.
Figure 13:
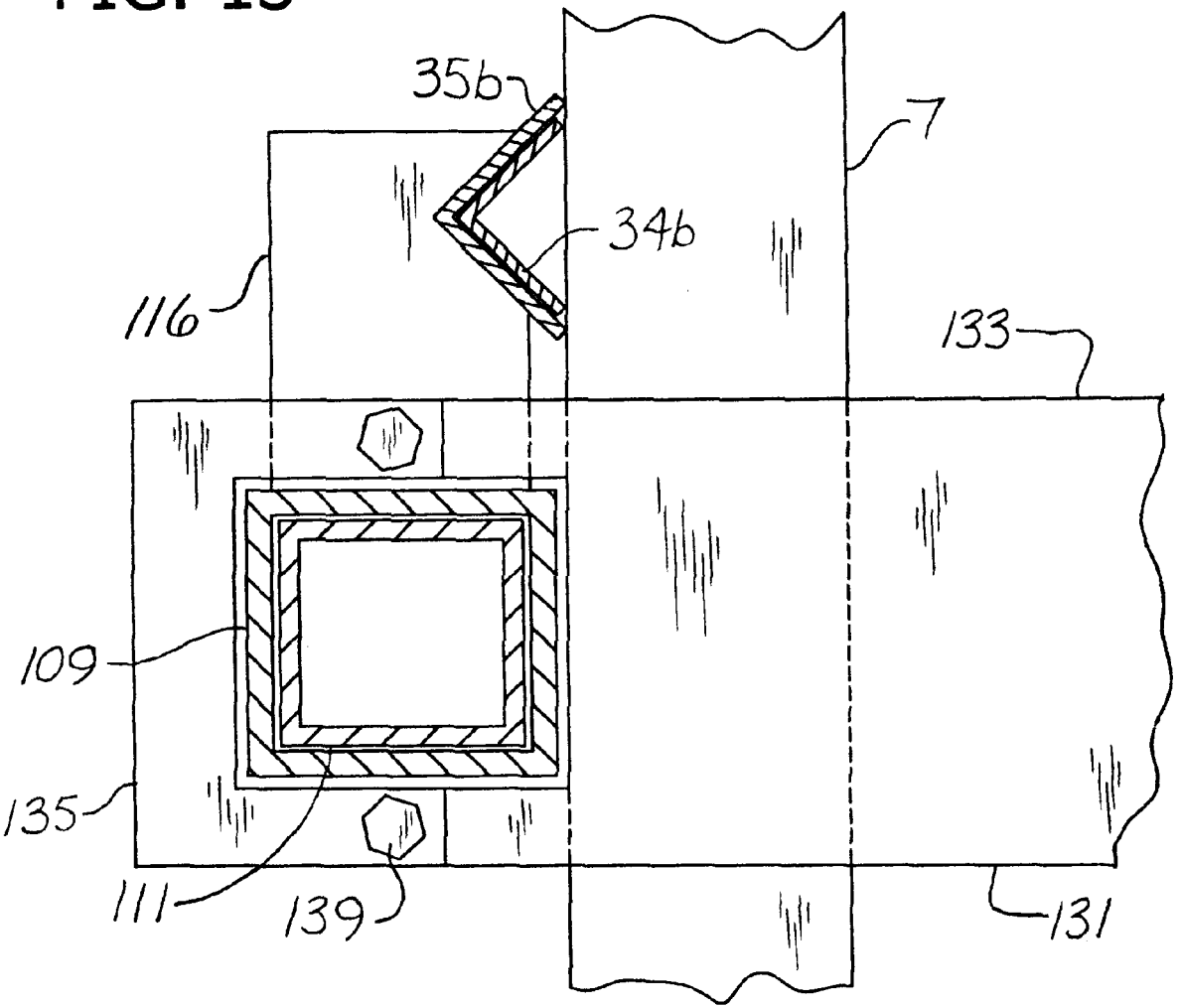
FIG. 13 is a fragmentary section view taken along line 13—13 of FIG. 12.

In the embodiment shown in FIGS. 12 and 13, one or more wall sections 1C of the present invention may be used as forms to construct permanent stoppings (sometimes referred to as a 'seal') of the type described in U.S. Pat. No. 5,167,474 (the '474 patent). Wall sections 1C are shown as being used to construct first and second form walls, generally designated 101 and 102, respectively. In this embodiment, each form wall comprises two wall sections 1C, but more or less sections can be used. Note that sections 1C as shown include a base, but it is contemplated that the non-free-standing sections described above with respect to FIGS. 17–20 may also be used as wall sections in the form walls.

In a method of the invention, section 1C of the first form wall 101 is positioned transversely with respect to the passageway with the base 3 of the section resting on the mine floor and the panels 5 extending up from the base. Another section 1C is positioned in end-to-end relation with the first section and connected thereto as described above to define the first form wall 101. Note that any of the connection means described herein may generally be used to connect the sections of the form walls. The second form wall 102 is constructed by positioning and connecting two more sections 1C generally parallel to and spaced from the first form wall to define a cavity 104 for receiving pourable and hardenable material, such as concrete, foamed cement or other suitable filler. The upper panel members 11 of each wall section are extended relative to the lower panel members 7 to bring the upper panel members into pressure engagement with the roof (not shown) of the mine passage and then secured in position as described above. Note that in this embodiment, the base 3 extends outward only from a side of the panels 5 opposite the cavity so that the form walls may be removed after the hardenable material is set.

In the preferred embodiment, each wall section 1C differs from the forms described in the '474 patent in that generally horizontal lower and upper reinforcing braces designated 105 and 106, respectively, are affixed to the panels 7 of each section 1C adjacent the tie bars. Such bracing reinforces the form wall against the substantial hydrostatic load of the hardenable material, and may eliminate or reduce the number of tie bars (e.g., tie bars designated 31 in FIG. 2 of the '474 patent) because the bracing reduces the load on the tie bars. Preferred bracing, including braces in combination with trusses, is described in co-pending U.S. patent application Ser. No. 09/464,808, which is incorporated herein by reference. It is to be noted that such bracing may also be used with any of the stopping sections described herein in lieu of or in addition to the tie bars 33*a,* 33*b*.

Briefly, each lower brace 105 comprises a fixed tube 109 and an elongate telescoping member 111 extensible relative to the fixed tube. The tubes may be rectangular in cross section or of any other suitable shape. The telescoping member 111 can be tubular or of solid stock material. An anchor plate (not shown) as disclosed in U.S. patent application Ser. No. 09/464,808 may be affixed to the free end 115 of the telescoping member 111 for engagement with a respective rib of the passageway. The fixed tube 109 is rigidly attached (e.g., welded) to inturned portions 17 of the flanges 15 of the lower panel members 7. The tie bar 33*b* may be attached to the fixed tube 109 as by a plurality of vertically-oriented gussets 116 spaced at intervals along the fixed tube and welded to both the tube and the tie bar 33*b*, though it is contemplated that the gussets be omitted. The tie bar 33*b* includes a telescoping portion 34*b* which is extensible relative to a fixed or main portion 35*b* of the tie bar 33*b* and which is attached by gussets 116 to the telescoping member 111. Each upper brace 106 is constructed substantially identically to lower brace 105 and is affixed to the lower panel members 7 as by welding, though other means of securing the brace are contemplated, such as by clamping the brace to the panels. It is contemplated that one brace or more than two braces may be used. Further, braces may be clamped or otherwise secured to the upper panel members 11 or to both the upper and lower panel members, rather than to the lower panel members 7 only. The anchor plates 113 on the upper and lower braces 105, 106 include holes (not shown) for fastening the plates to a mine rib RR or RL. In a preferred method, upon positioning the section 1C against the rib, the upper panels are extended to engage the roof and secured, as by application of ties to the tie bar 33*a*. In this embodiment, there is no connection between the braces 105 of the adjacent sections 1C at the juncture of the sections, but it is contemplated that connection means, such as fasteners, another telescoping member slipped through both braces at the juncture as described above with respect to FIG. 17, or other suitable connection means be provided to join the braces and thereby further reinforce the form.

For some applications, it may be preferable to space one or both sections 1C from the ribs RR or RL. The braces 105, 106 preferably telescope outward to engage ribs RR, RL so that extra panels placed between the section and the rib are reinforced by the braces.

Means may be attached to the form walls for retaining the form walls in spaced, generally parallel relation prior to, during and immediately after filling cavity 104 with hardenable material. Such means may include the one-piece ties 31 in the '474 patent or any other means disclosed in the '474 patent. Referring to FIG. 13, such means may also include multi-piece ties 131 having openings therein for receiving the tube 109 of the first and second form walls 101. Each tie 131 comprises a generally planar metal strap 133 extending through a juncture between adjacent panels 5 of each of the parallel form walls to engage respective tubes 109, and two C-shaped elements 135 (only one of which is shown). The ends of the strap (only one of which is shown in FIG. 13) are formed with channel-shaped openings or notches for receiving the tubes 109 on the two form walls. The C-shaped elements 135 are received about the tubes 109 and are attached to opposite ends of the strap as by bolts 139 thereby to fix the tie to the tubes 109. Attachment of the multi-piece ties 131 to the braces 105, 106 rather than to the tie bars 33*a*, 33*b* reduces the number of ties 131 required to withstand the hydrostatic load. This new configuration also eliminates the need for shorter braces 41 shown in FIG. 1 of the '474 and thereby allows the form wall to be more easily constructed and removed. Note that other ties may be used with the invention. For example, a suitable tie may be a strap fixed to the tubes 109 of the first form wall 101 and including means, such as a hook or fasteners for securing the tie to a substantially identical tie fixed to the tubes 109 of the second form wall 102. Such a tie is more suitable where the form will be left in place after the hardenable material is set since it will be difficult to detach the tubes 109 from the tie.

The form walls may be sealed as discussed above. Hardenable material is suitably poured into the cavity through an opening created by lowering one of the upper panel members 11, or through a panel member having an opening therein. The poured material is allowed to set. Thereafter, the form walls 101, 102 may be removed and re-used by unbolting C-shaped elements 135 from straps 133 (the straps 133 will remain in the hardened material), removing the ties 131 securing the upper panel members 9 in place, unbolting the anchor plates 113 from the ribs, sliding the upper panel members into the lower panel members 7, and removing the sections 1C.

It is to be understood that other connection means and quick-connect means for connecting adjacent wall sections are contemplated. It is also conceivable to use any combination of the connection means described herein with any of the wall sections described herein. For example, the telescoping connection means described with respect to FIG. 17 (section 1') may be used with section 1 to further reinforce the stopping.

In view of the above, it will be seen that the several objects of the invention are achieved and other advantageous results attained.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. A portable wall section for use in the formation of a stopping installed in a mine passage, said wall section comprising a plurality of elongate panels secured in adjacent, generally parallel, side-by-side relation for transport in said side-by-side relation as a portable assembly, said panels including end panels disposed at opposite ends of the wall section, each of said panels comprising a lower panel member having a lower end and an upper panel member extensible in an upward direction relative to the lower panel member for adjusting the overall height of the panel to accommodate mine passages of different heights, said panels forming a portable assembly which can be transported to an installation site in said mine passageway, and quick connect means on at least one of the end panels adapted for engaging another wall section to connect the wall sections.

2. A portable wall section as set forth in claim 1 further comprising a base adapted to rest on a floor of the mine passage, the lower end of each lower panel member being affixed to the base so that said plurality of elongate panels extend up from the base as a freestanding assembly.

3. A portable wall section as set forth in claim 2 further comprising bracing extending between the base and at least some of said lower panel members for strengthening the section.

4. A portable wall section as set forth in claim 1 wherein the elongate panels are substantially co-planar.

5. A portable wall section as set forth in claim 2 wherein said base and panels are fabricated from sheet metal, said base comprising a horizontal web and at least one flange extending down from the web along an edge of the base for penetrating the floor of the mine passage.

6. A portable wall section as set forth in claim 1 comprising an elongate element attached to said elongate panels for securing said panels in adjacent side-by-side relation.

7. A portable wall section as set forth in claim 6 wherein said elongate element is a tie bar.

8. A portable wall section as set forth in claim 1 wherein said panels are secured in side-by-side relation by adhesive.

9. A portable wall section as set forth in claim 1 wherein said panels are secured in side-by-side relation by fasteners.

10. A portable wall section as set forth in claim 1 further comprising securing means for securing each upper panel member in an extended position relative to the lower panel member.

11. A portable wall section as set forth in claim 10 wherein said upper and lower panel members are sheet metal members of channel shape, and wherein said upper panel member has a telescoping sliding fit with respect to the lower panel member, said securing means comprising one or more tie bars extending transversely with respect to the panels, and ties for securing the panels to said one or more tie bars.

12. A portable wall section as set forth in claim 1 wherein said portable assembly has a width which remains unchanged during transport of the assembly and subsequent installation in said mine passageway.

13. A portable wall section for use in the formation of a stopping installed in a mine passage, said wall section comprising a plurality of parallel elongate panels secured in adjacent side-by-side substantially co-planar relation for transport as a portable assembly, each of said panels comprising a lower panel member having a lower end and an upper panel member extensible in an upward direction relative to the lower panel member for adjusting the overall height of the panel to accommodate mine passages of different heights, said panels forming a portable assembly which can be transported to an installation site in said mine passageway.

14. A portable wall section as set forth in claim 13 further comprising a base adapted to rest on a floor of the mine passage, the lower end of each lower panel member being affixed to the base so that said plurality of elongate panels extend up from the base as a freestanding assembly.

15. A portable wall section as set forth in claim 14 further comprising bracing extending between the base and at least some of said lower panel members for strengthening the section.

16. A portable wall section as set forth in claim 15 wherein said base and panels are fabricated from sheet metal and said base comprises a horizontal web and at least one flange extending down from the web along an edge of the base for penetrating the floor of the mine passage.

17. A portable wall section as set forth in claim 13 comprising an elongate element attached to said elongate panels for securing said panels in adjacent side-by-side relation.

18. A portable wall section as set forth in claim 13 wherein said panels are secured in side-by-side relation by adhesive.

19. A portable wall section as set forth in claim 13 wherein said panels are secured in side-by-side relation by fasteners.

20. A portable wall section as set forth in claim 13 further comprising quick connect means on an end panel of the wall section for engaging another wall section to connect the two wall sections.

21. A wall section installed in a mine passage comprising a base resting on a floor of the mine passage, and a plurality of upright panels extending up from the base in adjacent side-by-side relation, each panel comprising a lower panel member having a lower end affixed to the base and an upper panel member extending from the lower panel member and having an upper end in substantial engagement with a roof of the mine passage, each upper and lower panel member made of sheet metal and each including a web and flanges at opposite sides of the web, each upper panel member having a telescoping sliding fit with respect to each respective lower panel member, and securing means for securing each upper panel member in an extended position relative to each respective lower panel member, said securing means comprising one or more tie bars extending transversely with respect to the panels above the base and ties for securing the panels to said one or more tie bars.

22. A wall section as set forth in claim 21 wherein said upper end of said upper panel member is defined by a head seal engaging the roof of the mine passage.

23. A method of installing a mine stopping at a site in a mine passage defined by a floor, roof and opposing side ribs, said method comprising transporting a wall section to the mine passage, the wall section as transported and as installed comprising a plurality of elongate upright panels secured in adjacent, side-by-side relation, each panel comprising a lower panel member and an upper panel member extensible in an upward direction relative to the lower panel member, positioning the wall section upright on the floor of said passage without changing the orientation of the lower panel members relative to one another, extending the upper panel members relative to the lower panel members to bring the upper panel members into pressure engagement with the roof of the mine passage, securing the upper panel members relative to the lower panel members in extended position, and closing any gaps between the panels and between the section and the side ribs of the mine passage.

24. A method as set forth in claim 23 wherein said closing step comprises installing bridging panels between the wall sections and the ribs of the mine passage to close any gaps therebetween.

25. A mine stopping system for installation in a mine passage to form a mine stopping, comprising a plurality of wall sections portable to the site as wall sections, each wall section comprising a plurality of elongate upright panels fixed in adjacent side-by-side relation, each panel comprising a lower panel member having a lower end and an upper panel member extensible in an upward direction relative to the lower panel member for adjusting the overall height of the panel to accommodate mine passages of different heights, and said wall sections being adapted to be installed in a position in which they extend transversely with respect to the mine passage to form at least part of said stopping.

26. A mine stopping system as set forth in claim 25 further comprising means for connecting the wall sections to form a stopping across the passageway.

27. A mine stopping system as set forth in claim 26 wherein said connecting means comprises at least one hinge.

28. A mine stopping system as set forth in claim 26 wherein said connecting means comprises a first bar attached to panels of one of said wall sections, a second bar attached to panels of an adjacent one of said wall sections, and a hinge connecting the two bars.

29. A mine stopping system as set forth in claim 26 wherein two of said plurality of wall sections are spaced apart forming a gap between the two sections, and wherein said connecting means comprises one or more elongate vertically extensible panels positioned to bridge the two sections and close the gap therebetween.

30. A mine stopping system as set forth in claim 26 wherein said connecting means connects one wall section to another wall section with substantially no gap between the two sections.

31. A mine stopping system as set forth in claim 30 wherein said connecting means comprises quick-connect components on said at least two wall sections releasably interengageable with one another for quickly connecting and disconnecting said wall sections.

32. A mine stopping system as set forth in claim 31 wherein said quick-connect components comprise pins on one wall section receivable in bayonet slots in the other wall section.

33. A mine stopping system as set forth in claim 25 wherein the lower ends of the lower panel members are attached to a base to fix the panels in adjacent side-by-side relation.

34. A mine stopping system as set forth in claim 25 wherein the panels are fixed in adjacent side-by-side relation by elongate elements connected to the panels.

35. A method of installing a mine stopping at a site in a mine passage defined by a floor, roof and opposing side ribs, said stopping being of the type comprising a plurality of portable wall sections, each wall section comprising a plurality of elongate upright panels and means for securing said upright panels in adjacent side-by-side relation, each panel comprising a lower panel member and an upper panel member extensible in an upward direction relative to the lower panel member, said method comprising positioning said wall sections in generally end-to-end relation to extend across the mine passage, extending the upper panel members relative to the lower panel members to bring the upper panel members into pressure engagement with the roof of the mine passage, securing the upper panel members relative to the lower panel members in extended position, and closing any gaps between the wall sections and any gaps between the wall sections and the side ribs of the mine passage.

36. A method as set forth in claim 35 further comprising sealing between the lower panel members of each wall section before said positioning step and sealing between the upper panel members after said extending step.

37. A method as set forth in claim 35 wherein said closing step comprises connecting the wall sections so that one wall section is immediately adjacent another wall section with no substantial gaps therebetween, and installing bridging panels between the wall sections and the ribs of the mine passage to close any gaps therebetween.

38. A method as set forth in claim 37 wherein said bridging panels are vertically extensible for fitting passageways of different heights and horizontally extensible for fitting gaps of different widths.

* * * * *